US009909492B2

(12) United States Patent
Jeswine

(10) Patent No.: US 9,909,492 B2
(45) Date of Patent: Mar. 6, 2018

(54) OPPOSED PISTON INTERNAL COMBUSTION ENGINE WITH INVISCID LAYER SEALING

(71) Applicant: PRIME GROUP ALLIANCE, LLC, Seattle, WA (US)

(72) Inventor: William Jeswine, Seattle, WA (US)

(73) Assignee: PRIME GROUP ALLIANCE, LLC, Seattle, WA (US)

( * ) Notice: Subject to any disclaimer, the term of this patent is extended or adjusted under 35 U.S.C. 154(b) by 0 days.

(21) Appl. No.: 14/215,491

(22) Filed: Mar. 17, 2014

(65) Prior Publication Data

US 2014/0318518 A1 Oct. 30, 2014

Related U.S. Application Data

(60) Provisional application No. 61/789,231, filed on Mar. 15, 2013.

(51) Int. Cl.

| | |
|---|---|
| ***F02B 75/02*** | (2006.01) |
| ***F01B 1/08*** | (2006.01) |
| ***F01B 9/02*** | (2006.01) |
| ***F02B 33/22*** | (2006.01) |
| *F02B 75/24* | (2006.01) |
| *F02B 75/32* | (2006.01) |

(52) U.S. Cl.

CPC ..... *F02B 75/02* (2013.01); *F01B 1/08* (2013.01); *F01B 9/023* (2013.01); *F02B 33/22* (2013.01); *F02B 75/246* (2013.01); *F02B 75/32* (2013.01); *F02B 2075/025* (2013.01)

(58) Field of Classification Search

CPC ..... F01B 9/023; F01B 9/026; F01B 9/047; F16H 21/36

USPC ..... 123/73 R

See application file for complete search history.

(56) References Cited

U.S. PATENT DOCUMENTS

| | | | | |
|---|---|---|---|---|
| 1,825,278 | A * | 9/1931 | Marvin | 123/55.7 |
| 1,978,335 | A | 10/1934 | Augustine | |
| 2,059,804 | A | 11/1936 | O'Bryan | |
| 2,217,912 | A | 10/1940 | Lindsey | |
| 2,513,514 | A * | 7/1950 | Poage | 74/50 |
| 3,200,800 | A | 8/1965 | Du Bois | |
| 3,921,985 | A * | 11/1975 | Fimml | F01D 11/00 123/536 |
| 4,876,991 | A * | 10/1989 | Galitello, Jr. | 123/46 E |
| 5,799,628 | A * | 9/1998 | Lacerda | 123/52.3 |
| 2006/0196456 | A1 | 9/2006 | Hallenbeck | |

(Continued)

FOREIGN PATENT DOCUMENTS

| | | |
|---|---|---|
| DE | 102007011927 | 11/2008 |
| FR | 2321597 | 3/1977 |

*Primary Examiner* — Kevin A Lathers

(74) *Attorney, Agent, or Firm* — Smith, Gambrell & Russell, LLP

(57) ABSTRACT

An opposed-piston engine that forms an inviscid layer between pistons and the respective cylinder walls. In an aspect, the opposed-piston engine utilizes a Scotch yoke assembly that includes rigidly connected opposed combustion pistons. In an aspect, the Scotch yoke assembly is configured to transfer power from the combustion pistons to a crankshaft assembly. In an aspect, the crankshaft assembly can be configured to have dual flywheels that are internal to the engine, and can be configured to assist with an exhaust system, a detonation system, and/or a lubrication system.

26 Claims, 31 Drawing Sheets

(56) References Cited

U.S. PATENT DOCUMENTS

| | | | | |
|---|---|---|---|---|
| 2011/0083644 | A1* | 4/2011 | Dougherty | 123/51 R |
| 2011/0162630 | A1* | 7/2011 | Takayanagi | 123/73 V |

* cited by examiner

A-A

B-B

C-C

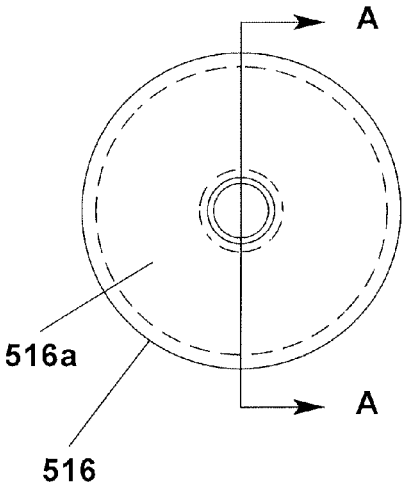
Fig. 13
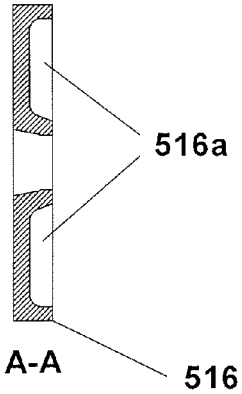
Fig. 13A
Fig. 14a
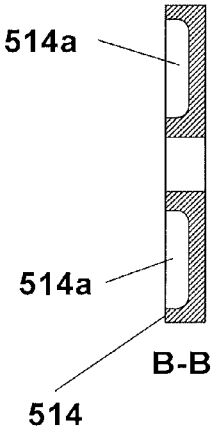
Fig. 14A
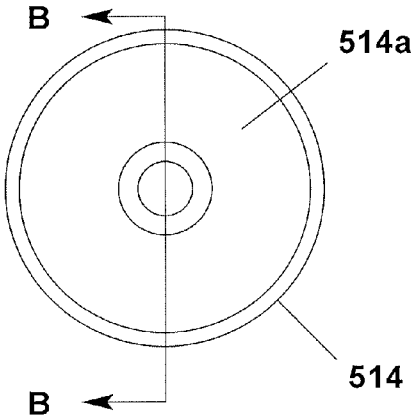
Fig. 14

OPPOSED PISTON INTERNAL COMBUSTION ENGINE WITH INVISCID LAYER SEALING

CLAIM OF PRIORITY

This application claims priority from U.S. Provisional Patent Application 61/789,231, filed Mar. 15, 2013, which is relied upon and incorporated herein in its entirety by reference.

BACKGROUND

Field of Invention

The invention relates to a combination of spark ignited and compression ignited two cycle engines.

Background of Invention

Generally, internal combustion engines are divided into two classes: spark ignited and compression ignited. Both internal combustion engine types have their advantages and disadvantages. Spark ignited engines have lower compression ratios, weigh less and are easier to start as they initiate fuel burn after top dead center. However, spark ignited engines are less efficient as they release burning fuel out the exhaust. Compression ignited engines, known as diesel engines, have much higher compression ratios and therefore require more energy to start. Compression engines are more efficient, as the fuel is fully combusted inside the cylinder but detonated before top dead center. Typically, spark ignited engines efficiency is in the low 40% range, whereas diesel type engines typically have an efficiency in the mid-40% range, even though they lose energy by detonating before top dead center.

Therefore, there is a need in the industry to combine many of the best aspects of both types of engines.

SUMMARY OF INVENTION

The present invention is directed to a low friction two cylinder, two cycle opposed-piston internal combustion engine. In an aspect, the two cylinder, two cycle opposed-piston internal combustion engine utilizes two combustion cylinders with a Scotch yoke assembly. In an aspect, the Scotch yoke assembly includes two combustion pistons connected together through a Scotch yoke base. The combustion pistons are configured to operate within the combustion cylinders.

In an aspect, the two cylinder, two cycle opposed-piston internal combustion engine can include a pair of compression cylinders. In such aspects, the Scotch yoke assembly can include two compression pistons configured to operate within the compression cylinders. In an aspect, the two opposed compression pistons can be configured to be driven by the Scotch yoke base to function as an air compressor.

In an aspect, the Scotch yoke base keeps both sets of pistons in accurate concentricity to their respective cylinder walls, enabling close tolerances without actual contact between the pistons and their respective cylinder walls. In an aspect, the Scotch yoke assembly includes a Scotch yoke guide shaft configured to guide the movement of the Scotch yoke base and connected pistons. In an aspect, the combination of the Scotch yoke base and the opposed combustion pistons, compression pistons, and the Scotch yoke guide shaft also enables the establishment of a near frictionless inviscid layer seal allowing the compression and combustion pistons to compress on both sides of the heads of the pistons without the use of piston rings.

In an aspect, some compressed air is used to purge the exhaust gases out of the combustion cylinder, which is released from the backside of the combustion piston. The remaining air can be used in the combustion cycle. In an aspect, the two cylinder, two cycle opposed-piston engine is configured so that the combustion air is introduced at the bottom of the stroke, and as it is being compressed, fuel is injected at multiple points during the compression stroke to facilitate mixing.

In an aspect, the two cylinder, two cycle opposed-piston engine is configured to initially start with a spark plug. As the engine warms up, some of the combustion gases are captured by a detonator accumulator system. In an aspect, the detonator accumulator system can utilize detonation valves and a detonation accumulator chamber to capture combustion gases from one combustion cylinder and to release the collected combustion gases into the opposing combustion cylinder to initiate fuel detonation. In an aspect, the detonation valve to the detonation accumulator chamber opens in time to detonate the fuel within the combustion cylinder and remains open long enough to recharge the detonation accumulator chamber with fresh high-temperature high-pressure gases to be used to detonate the opposing combustion cylinder. In an aspect, detonation occurs at top dead center or slightly after top dead center.

In an aspect, the two cylinder, two cycle opposed-piston engine can utilize two flywheels inside of a crankcase area on either side of the Scotch yoke. In an aspect, the flywheels can be configured to provide an inviscid layer for lubrication of components of the two cylinder, two cycle opposed-piston engine. In an aspect, the two cylinder, two cycle opposed piston engine can be configured to isolate the two flywheels within the crankcase.

In an aspect, the use of the Scotch yoke assembly and inviscid layer sealing eliminates the need for cylinder lubrication. Therefore all major lubrication takes place in a sealed crankcase. The crankcase may be configured to be in close proximity to the two flywheels, and sufficient lubricant is installed to allow portions of the flywheels to interface with the lubricant no matter the angle of the engine. In an aspect, parasitic drag between the flywheels and the lubricant causes the lubricant to vaporize. In an aspect, the vaporized lubricant is collected into a pickup and return tube system through parasitic drag and then transmitted to an exhaust valve assembly. Likewise, parasitic drag is used to create a low pressure path to return the excess vaporized lubricant back to the crankcase.

In an aspect, one flywheel actuates both exhaust valves and the other actuates both accumulator detonation valves. In another aspect, one flywheel can operate the opening of the exhaust valves and the other flywheel can operate the closing of the exhaust valves. In another aspect, one of the flywheels can be configured to control some operation of the exhaust valves and accumulator detonation valves. In an aspect, the two flywheels can include valve cams to actuate the exhaust valves and accumulator detonation valves.

In an aspect, mechanical power is transmitted from the combustion pistons through the respective connecting rods through the Scotch yoke base to the crankshaft through a multi-rotational element bearing. That power is transmitted to the output shafts located on both sides of the engine. In an aspect, the output shafts can include a male spline on one end of the crankshaft and a female spline on the other end of the crankshaft. In this way multiple engines can be cascaded for added power.

In an aspect, the two cylinder, two cycle opposed-piston engine can be configured to generate electricity. In an aspect, the cylinder walls of the two cylinder, two cycle opposed-piston engine can be lined with ceramic material. Inside of the ceramic lining, copper coils can be embedded and the pistons can be fitted with high-strength magnets since the combustion pistons never actually contact the walls of the combustion cylinders. As the pistons go back and forth through the coils, the magnetic lines of force are cut and an electric current is generated in the windings. That current is transmitted to a power conditioning module which conditions the power appropriately.

These and other objects and advantages of the invention will become apparent from the following detailed description of the preferred embodiment of the invention.

Both the foregoing general description and the following detailed description are exemplary and explanatory only and are intended to provide further explanation of the invention as claimed. The accompanying drawings are included to provide a further understanding of the invention and are incorporated in and constitute part of this specification, illustrate several embodiments of the invention, and together with the description serve to explain the principles of the invention.

BRIEF DESCRIPTION OF THE DRAWINGS

FIG. 13 is a front plan view of a valve spring retainer of FIG. 12B.

FIG. 13A is a cross-sectional view of the spring retainer of FIG. 13 along line A-A.

FIG. 14 is a front plan view of a valve spring base of FIG. 12B.

FIG. 14A is a cross-sectional view of the valve spring base of FIG. 14.

DETAILED DESCRIPTION OF THE PREFERRED EMBODIMENTS

Figure 1:
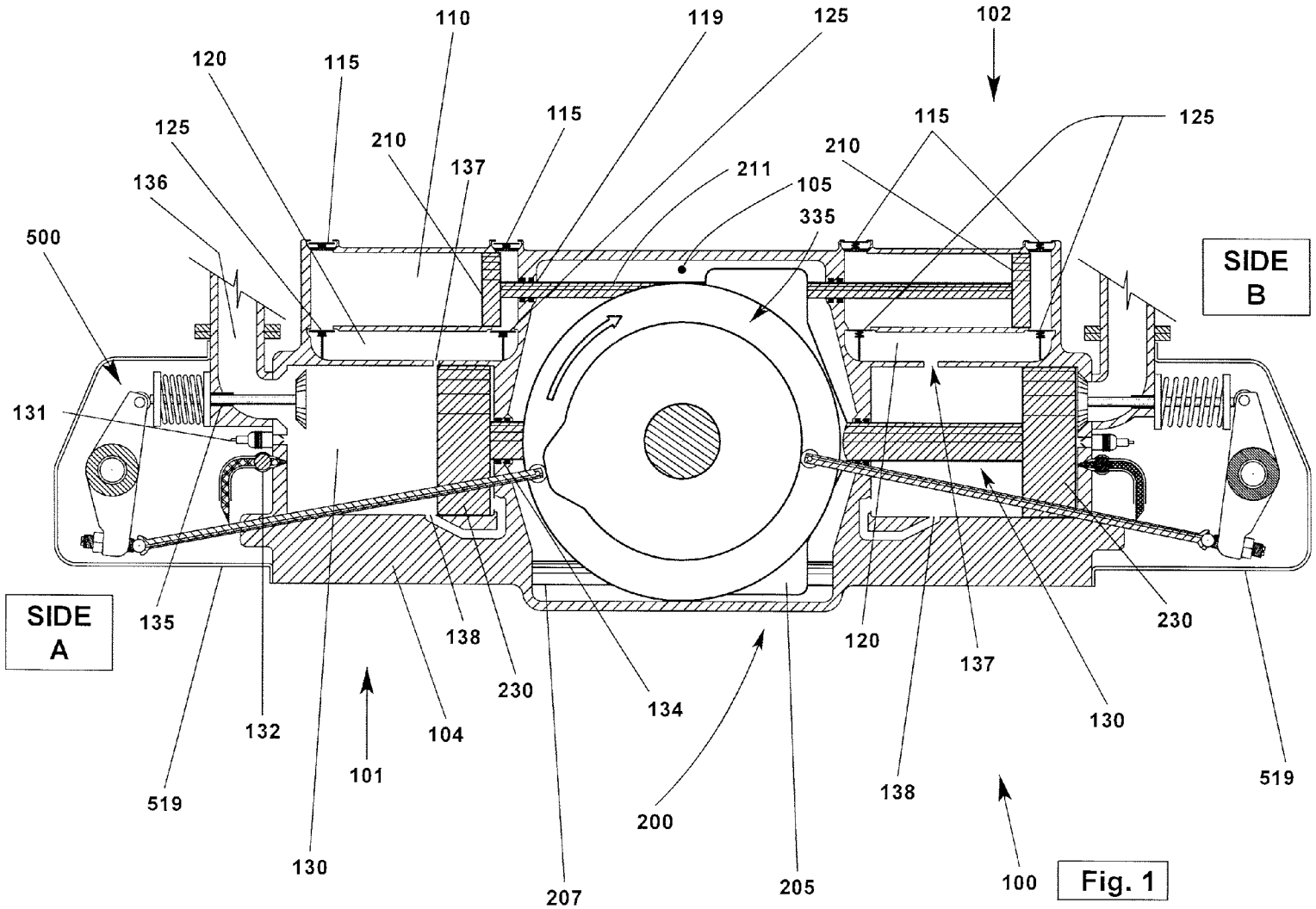
FIG. 1 is cross-sectional side view of a two cylinder, two cycle opposed-piston engine viewed from an exhaust camshaft side according to an aspect.

Before the present methods and systems are disclosed and described, it is to be understood that the methods and systems are not limited to specific synthetic methods, specific components, or to particular compositions. It is also to be understood that the terminology used herein is for the purpose of describing particular embodiments only and is not intended to be limiting.

As used in the specification and the appended claims, the singular forms "a," "an" and "the" include plural referents unless the context clearly dictates otherwise. Thus, for example, reference to an "outer-inner race", or "bearing element" can include two or more such elements unless the context indicates otherwise.

Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

References will now be made in detail to the present preferred aspects of the invention, examples of which are illustrated in the accompanying drawings. Wherever possible the same reference numbers are used throughout the drawings to refer to the same or like parts.

As illustrated in FIGS. 1-33, the current invention is directed to an improved 2 cylinder, 2 cycle opposed-piston internal combustion engine 100 (herein the "opposed-piston engine"). In an aspect, the opposed-piston engine 100 comprises two engine segments 101, 102 opposite one another, with segment 101 oriented on side A and segment 102 oriented on side B, as shown throughout the figures. In an aspect, the two segments 101, 102 operate as separate engines. In an aspect, the two engine segments 101, 102 of the opposed-piston engine 100 share common components with each other, operating 180 degrees opposite of each other, thus providing two power strokes each revolution. As shown in FIG. 1, the two engine segments 101, 102 are oriented on opposite sides A, B of the opposed-piston engine 100.

In an aspect, the two engine segments 101, 102 share certain common components. In an exemplary aspect, the two engines 101, 102 of the opposed-piston engine 100 share an engine case 104. The engine case 104 can form a crankcase 105, discussed in more detail below. The two engine segments 101, 102 can also share a Scotch yoke assembly 200 Scotch, a crankshaft assembly 300, an exhaust cam flywheel 330, a detonator cam flywheel 335, main bearings 360, a control module (not shown for clarity) and the crankshaft angle sensor (not shown for clarity), amongst others discussed in more detail below.

The Scotch yoke assembly 200 is configured to control the functions of the opposed-piston engine 100. In an aspect, as illustrated in FIGS. 4-5A and 7, the Scotch yoke assembly 200 comprises a Scotch yoke base 205, a Scotch yoke guide shaft 207, compression pistons 210, and combustion pistons 230. The Scotch yoke base 205 is configured to rigidly connect the compression pistons 210 and combustion pistons 230 in opposed fashion, as shown in FIGS. 4-5A and 7. In an aspect, the Scotch yoke base 205 is connected to the compression pistons 210 and the combustion pistons 230 through respective connecting rods 211, 231, discussed in detail below. The Scotch yoke base 205 is further configured to transfer energy from the combustion pistons 230 to a crankshaft assembly 300. In an aspect, the Scotch yoke base 205 transfers the energy through a slotted raceway 206 that is configured to interact with the crankshaft assembly 300.

The Scotch yoke base 205 is configured to oscillate within the crankcase 105 during the operation of the opposed-piston engine 100. The Scotch yoke guide shaft 207 supports the linear motion of the Scotch yoke base 205 within the crankcase 105. In an aspect, the Scotch yoke guide shaft 207 is rigidly connected to the engine case 104, and the shaft 207 is received by a linear bearing 209 oriented within the Scotch yoke base 205, as shown in FIGS. 1, 4, 5, 5A and 7. The Scotch yoke guide shaft 207 is aligned in parallel with the connecting rods 211, 231 of compression pistons 210 and combustion pistons 230 respectively, as well as with the linear bearings and seals associated with each. The combination of the Scotch yoke guide shaft 207 and the connecting rods 211, 231, including their parallel alignment, establish concentricity and close proximity of the pistons 210, 230 to the walls of their respective cylinders 110, 130, discussed below in detail, as well as to establish and maintain a near frictionless fluid inviscid layer seal between the pistons and walls. The inviscid layer formed between the pistons and walls of the cylinders does the work of conventional piston rings, forming a seal between the pistons and cylinder walls. In an aspect, the inviscid layer is formed by the fluid that is contained within the given cylinders. Such fluid can be air or a mixture of air and fuel, and retain all properties between the walls of the cylinders and the piston heads without retaining viscosity.

Referring back to FIG. 1, the engine case 104 of the opposed-piston engine 100 provides the needed structure for both engine segments 101, 102. The engine case 104 supports a plurality of paired chambers and cylinders parallel to each other. In an aspect, the engine case 104 supports pairs of compression cylinders 110, accumulator chambers 120, and combustion cylinders 130. In an aspect, the side A engine segment 101 contains at least one compression cylinder 110, accumulator chamber 120, and combustion cylinder 130 that are aligned with the corresponding compression cylinder 110, accumulator chamber 120, and combustion cylinder 130 found in the side B engine segment 102. In such an aspect, the compression cylinders 110, accumulator chambers 120, and combustion cylinders 130 found in each engine segment 101, 102 are parallel with each other.

In an aspect, the two compression cylinders 110 are configured to allow the compression pistons 210 to travel within them. The compression pistons 210 are configured to compress air within the compression cylinders 110 in order to provide charged air to the combustion cylinders 130. The compression pistons 210 are connected to one another through a compression connecting rod 211, which is then secured to the Scotch yoke base 205. In another aspect, the compression pistons 210 can be connected to the Scotch yoke base 205 with individual connecting rods.

Figure 4:
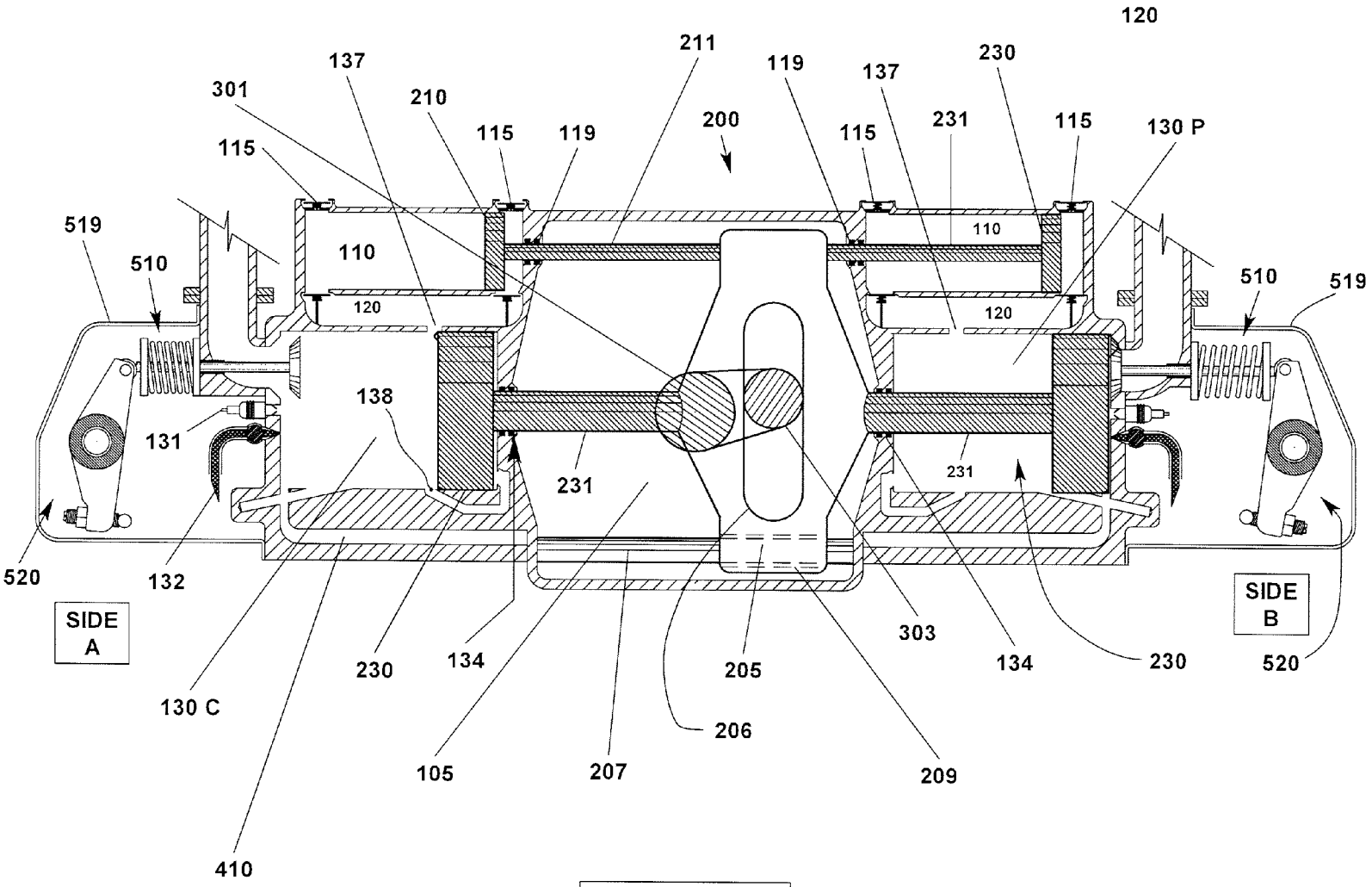
FIG. 4 is a cross-sectional side view of the two cylinder, two cycle opposed-piston engine of FIG. 1.
Figure 5:
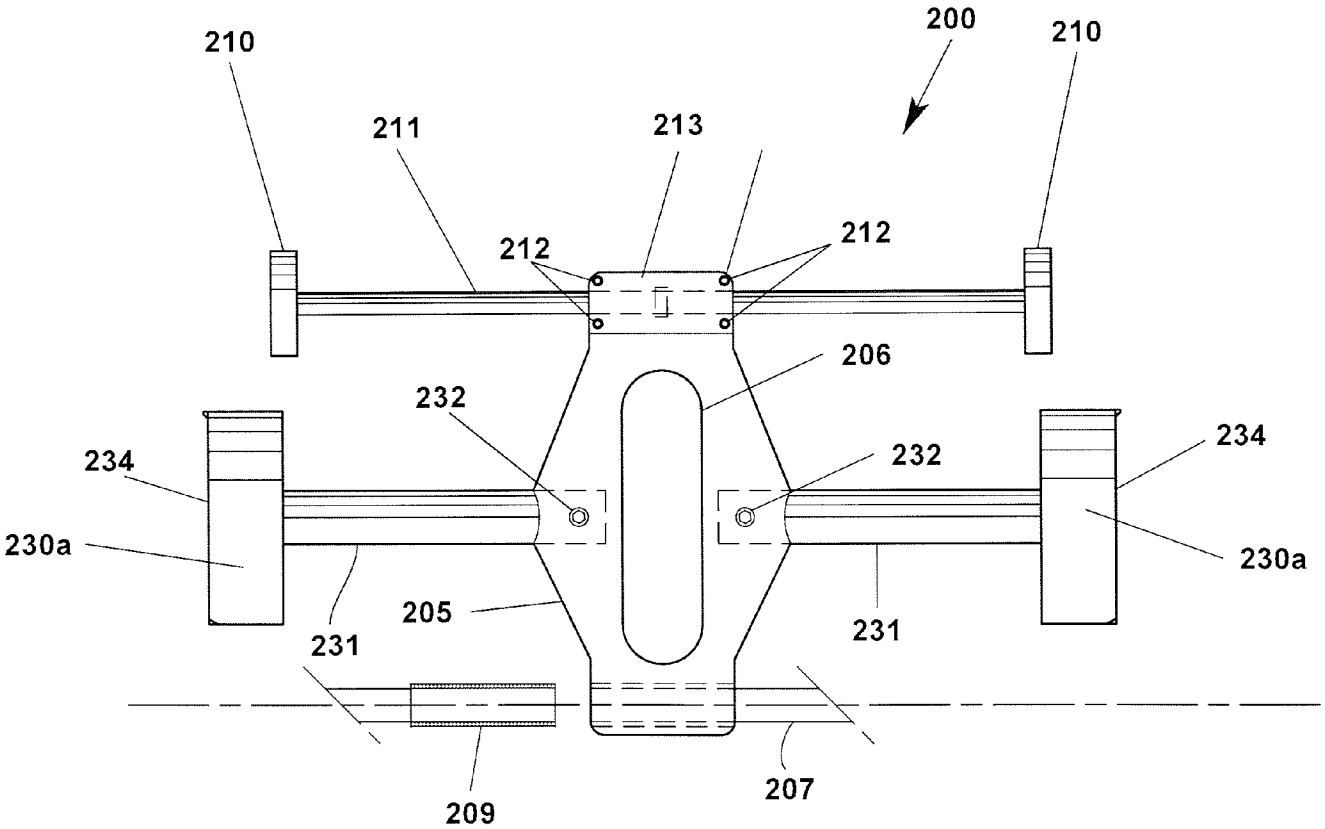
FIG. 5 is a plan side view of a Scotch yoke assembly of the two cylinder, two cycle opposed-piston engine of FIG. 4.
Figure 5A:
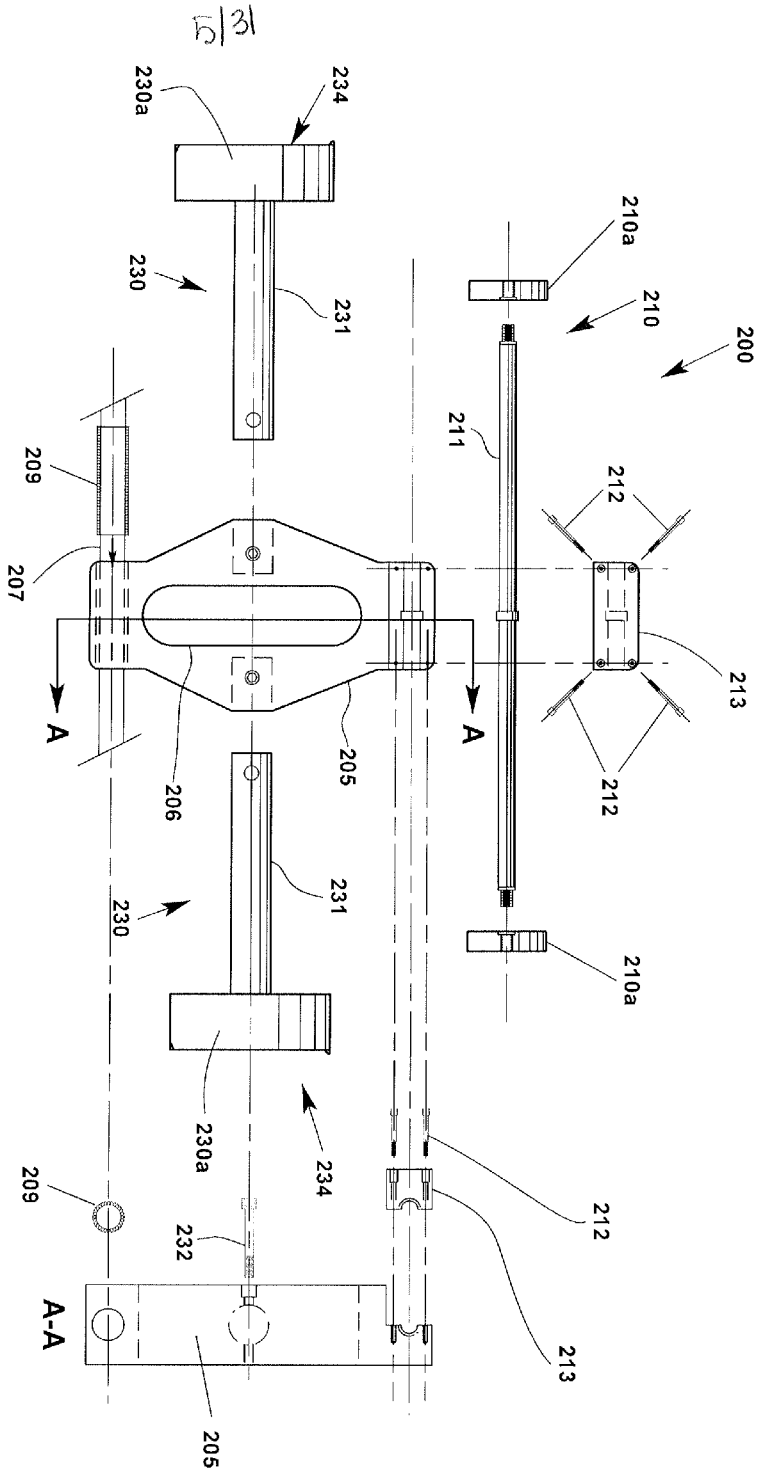
FIG. 5A is an exploded plan side view of the Scotch yoke assembly of FIG. 5.
Figure 7:
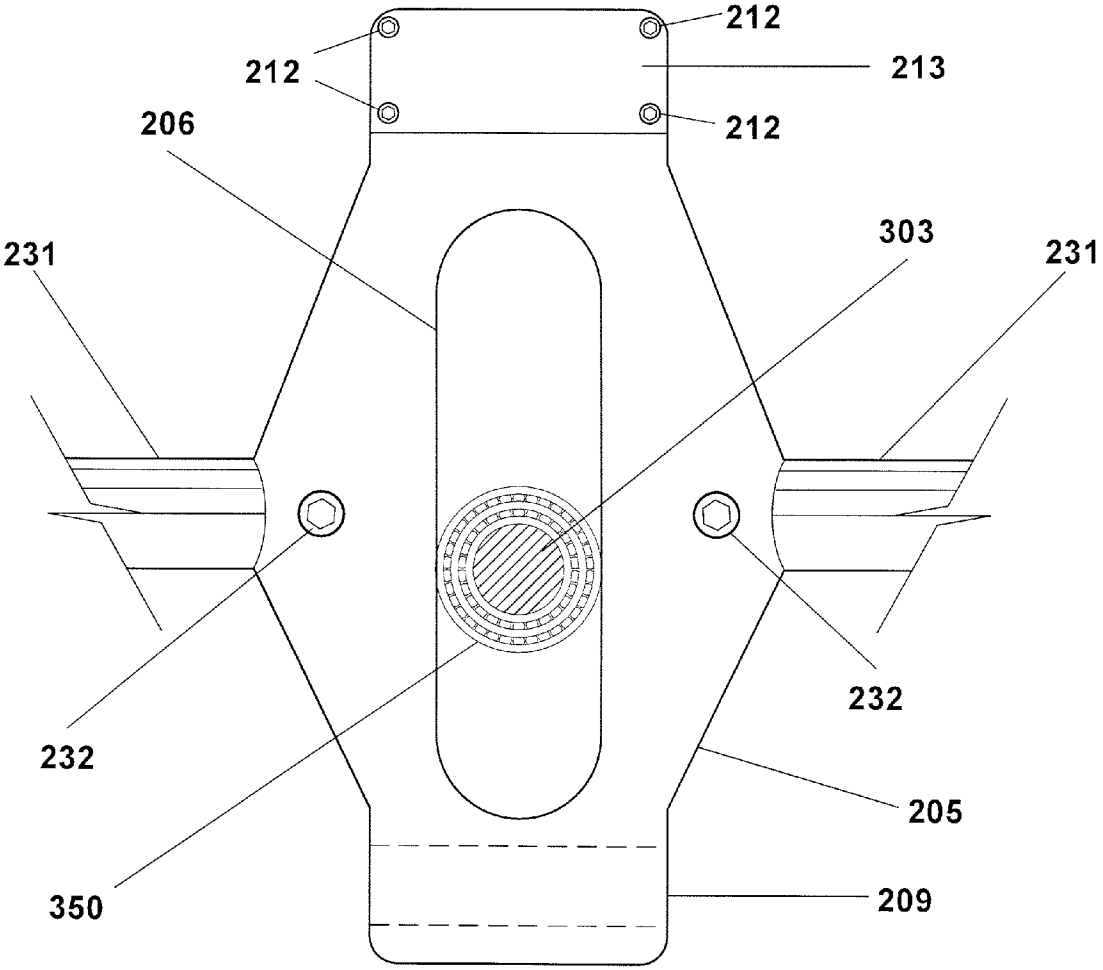
FIG. 7 is a front plan view of an interface between a Scotch yoke raceway and a crankshaft assembly according to an aspect.

In an aspect, the compression connecting rod 211 is configured to extend through apertures (not shown) in the engine case 104 that extend from the compression cylinders 110 into the crankcase 105. Compressor linear bearings and seals 119 engage the connecting rod 211 within the apertures and allow the connecting rod 211 to travel within the compression cylinders 110 while isolating the crankcase 105 from the compression cylinders 110, keeping air from escaping from the compression cylinders 110 into the crankcase 105, as shown in FIG. 4. The compression connecting rod 211 is secured to the Scotch yoke base 205. In an aspect, the compression connecting rod 211 is secured to the Scotch yoke base 205 with a combination of fasteners 212 and retention clamps 213, as shown in FIGS. 5, 5A and 7.

The movement of the compression pistons 210, connected by the compression connecting rod 211, is controlled by the Scotch yoke base 205, with the connecting rod 211 and the compression pistons 210 moving in connection with the Scotch yoke base 205. With the compression pistons 210 connected to the same compression connecting rod 211 and connected to the Scotch yoke base 205 (or when two separate connecting rods 211 are connected to the Scotch yoke base 205), the compression pistons 210 in opposite compression cylinders 110 move in concert with one another. More specifically, when the compression piston 210 on side A of the opposed-piston engine 100 (i.e., the first segment 101) is located at the end of the compression cylinder 110 furthest away from the crankcase 105, the compression piston 210 on side B (i.e., second segment 102) will be located closer to the crankcase 105, and vice versa. In an aspect, the compression pistons 210 are configured to travel within the compression cylinders 110 without engaging the walls of the compression cylinders 110. In such aspects, the compression cylinders 110 do not need piston rings or lubrication beyond the inviscid layer, as discussed above and further 1 below.

Figure 2:
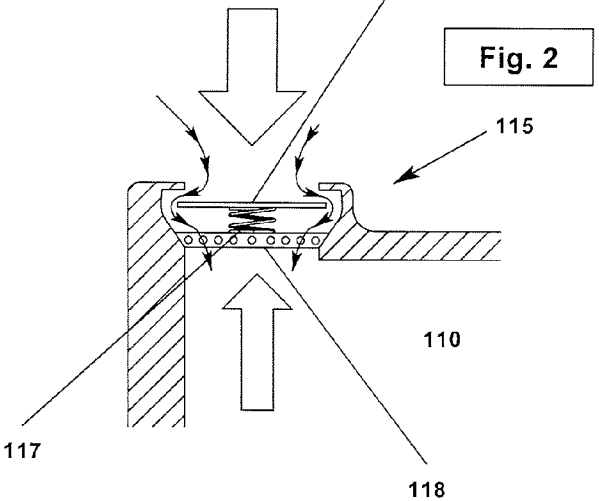
FIG. 2 is a cross-sectional view of an intake check valve assembly of the two cylinder, two cycle opposed-piston engine of FIG. 1 in an open position.
Figure 2A:
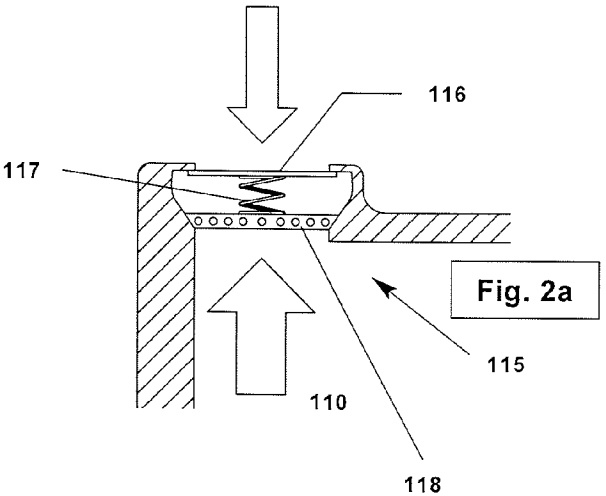
FIG. 2*a* is a cross-sectional view of the intake check valve assembly of FIG. 2 in a closed position.

The compression cylinders 110 are further configured to include at least one one-way intake valve assembly 115, shown in FIGS. 1, 2, 2A. In an exemplary aspect, each compression cylinder 110 includes two one-way intake valve assemblies 115. However, in other aspects, the compression cylinders 110 can include more than two one-way intake valve assemblies 115. The one-way intake valve assembly 115 comprises a valve face 116 connected to a spring 117 secured on a spring support 118. The spring support 118 is further configured to allow air to travel through the spring support 118 while still providing support for the spring 117. In an aspect, the spring support 118 can be configured with passage ways, apertures, or the like to allow ambient air to past through.

The one-way intake valve assemblies 115 are configured to allow ambient air into the compression cylinders 110. In an aspect, when the air pressure of the ambient air is greater than the air pressure within the compression cylinders 110, the ambient air, applying pressure on the surface of the valve face 116, compresses the spring 117, allowing air into the compression cylinders 110, as shown in FIG. 2. When the air pressure is greater within the compression cylinders 110 than the pressure of the ambient air, the valve face 116 and spring 117 are fully extended, preventing any ambient air from entering into the compression cylinders 110, as shown in FIG. 2A.

Figure 3:
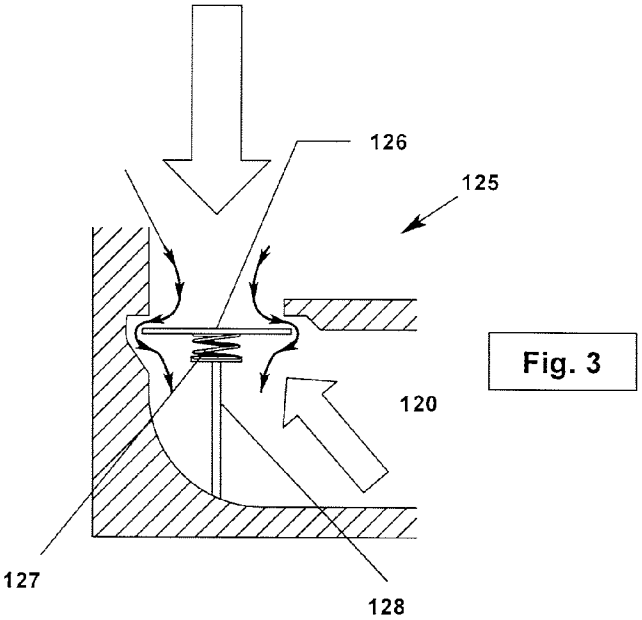
FIG. 3 is a cross-sectional view of an air accumulator check valve assembly of the two cylinder, two cycle opposed-piston engine of FIG. 1 in an open position.
Figure 3A:
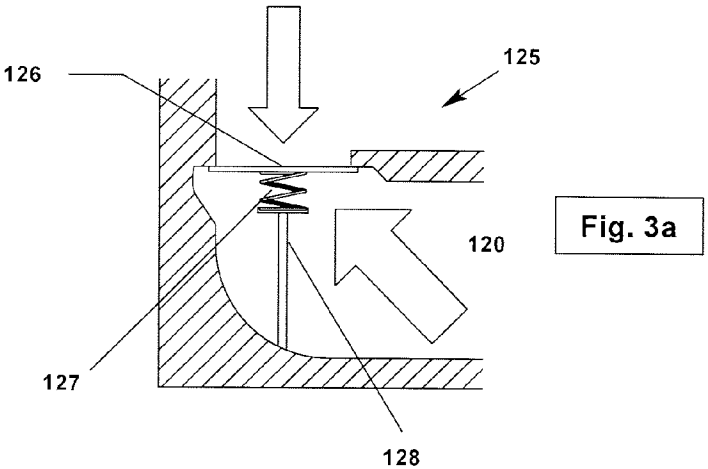
FIG. 3*a* is a cross-sectional view of the air accumulator check valve assembly of FIG. 3 in a closed position.

Adjacent the compression cylinders 110 are the accumulator chambers 120, as shown in FIGS. 1 and 3-4. The accumulator chambers 120 are configured to hold compressed air from the compression cylinders 110 between power strokes for later delivery to the combustion cylinders 130 since it takes a back and forth cycle of the compression pistons 210 to accumulate enough air volume to double the air charge in the combustion cylinder 130. The accumulator chambers 120 receive air from the compression cylinders 110 through check valve assemblies 125, as shown in FIGS. 1, 3 and 3A. In an exemplary aspect, each air accumulator chamber 120 includes two check valve assemblies 125. However, in other aspects, the air accumulator chambers 120 can include more than two check valve assemblies 125. Similar to the one one-way intake valve assemblies 115, the check valve assemblies 125 are configured to allow air into the accumulator chambers 120. The check valve assemblies 125 comprises a valve face 126 connected to a spring 127 secured on a spring support 128. In an aspect, the spring support 128 can comprise a pole secured to the surface of the accumulator chamber 120.

The check valve assemblies 125 are configured to allow air from the compression cylinders 110 into the accumulator chambers 120. In an aspect, when the air pressure of the air within the compression cylinders 110 is greater than the air pressure within the accumulator chambers 120, the air within the compression cylinders 110 apply pressure on the surface of the valve face 126, compressing the spring 127, allowing air into the accumulator chambers 120, as shown in FIG. 2. When the air pressure is greater within the accumulator chambers 120 than the air in the compression cylinders 110, the pressure of the air in the accumulator chambers 120 is applied to the back of the valve face 126, with the spring 127 fully extended, preventing air from entering into the accumulator chambers 120, as shown in FIG. 3A. In an aspect, the accumulator chambers 120 also include an intake port 137, discussed in more detail below.

In an aspect, the opposed-piston engine 100 includes combustion cylinders 130. The combustion cylinders 130 are adjacent the air accumulator chambers 120 on the side opposite the compression cylinders 110, as shown in FIGS. 1 and 4. As discussed above, the combustion cylinders 130 are configured to allow combustion pistons 230 to travel within the combustion cylinders 130, discussed in detail below. In an aspect, the combustion pistons 230 are connected to the Scotch yoke base 205 through connection rods 231. In an aspect, the connection rods 231 of the combustion pistons 230 are surrounded by bearings 134 as the connection rods 231 passes through apertures in the engine case 104 to the crankcase 105 in order to isolate the crankcase 105 from the combustion cylinders 130.

In an aspect, an electrode-end of at least one spark plug 131 is configured to reside within the combustion cylinders 130, as shown in FIGS. 1 and 4. In other aspects, a plurality of spark plugs 131 (e.g., see FIG. 32) can be used in each combustion cylinder 130. In an aspect, a control module (not shown for clarity) can be configured to control the operation of the spark plug 131. In an exemplary aspect, the spark plug 131 is oriented within the combustion cylinder 130 at the end furthest from the crankcase 105. Adjacent the spark plug 131 is a fuel injector 132. In an aspect, a crankshaft angle sensor (not shown for clarity) can be configured to initiate the operation of the fuel injector 132, with the control module discussed above controlling the continued function of the fuel injector 132. In other aspects, a plurality of fuel injectors 132 (e.g., fuel injectors 1132 of FIG. 31) can be used in each combustion cylinder 130 in order to increase the overall efficiency of the combustion of the fuel. In an exemplary aspect, the fuel injector 132 can be configured to be pulsed, sending in multiple short bursts of fuel as the combustion piston 230 is compressing the fuel/air mix. In an aspect, as shown in FIGS. 1, 4, 12, 12A, and 12B, a valve guide 135 can be found centered in an exhaust port 136 leading to an exhaust manifold 540, discussed in detail below. The valve guide 135 can be configured to assist with an exhaust valve 511 of an exhaust assembly 500. The exhaust assembly 500 is configured to seal the combustion cylinder 130 off from the exhaust port 136 when combustion is occurring in the combustion cylinder 130, discussed in detail below.

The combustion cylinder 130 includes an intake port 137 configured to provide a passage way for the charged air to enter into the combustion cylinder 130 from the accumulator chamber 120. In an aspect, the combustion cylinder 130 can include a purge port 138 can be found opposite the intake port 137. The purge port 138 is configured to purge exhaust and unused fuel from the combustion chamber when an exhaust valve 511 is opened, discussed in detail below.

The combustion pistons 230 are configured to move within the combustion cylinders 130. In an aspect, the combustion pistons 230 are configured to travel back and forth through the combustion cylinders 130 without coming in contact with the walls of the combustion cylinders 130, thereby eliminating the need for piston rings on the pistons 230, greatly reducing the friction and thereby the need of lubricants within the combustion cylinders 130. The head 230*a* of the combustion pistons 230 are connected to the Scotch yoke base 205 through piston connecting rods 231. The piston connecting rods 231 are connected to the Scotch yoke base 205 with retainer fasteners 232. By connecting the combustion pistons to a Scotch yoke base 205 and limiting the motion of the pistons 230 and connecting rods 231 to a linear fashion, the pistons 230 do not need to be able to pivot from the connecting rods 231, and therefore do not need wrist pins or rotating connecting rods, which are replaced by the rigid connecting rods 231. By eliminating the need of wrist pins, the pistons 230 are not able to rock back and forth within the cylinders 130, thereby avoiding making contact with the cylinder walls, which would destroy the invicsid layer and seal. In addition, wrist pins also add weight and eat energy, thereby reducing the overall efficiency of an engine.

The combustion pistons 230 in combination with the combustion cylinders 130 can be used for combustion purposes, as well as purging purposes. In an aspect, the heads 230*a* of the combustion pistons 230 movably bisect their respective combustion cylinders 130 into two segments: a combustion segment 130C and a purge segment 130P. The combustion segment 130C is found on the face-side 234 of the head 230*a* of the combustion piston 230, with the purge segment 130P found on the connecting rod side of the head 230*a*. As the combustion pistons 230 move within the combustion cylinders 130, the length and volume of the combustion segment 130C and the purge segment 130P changes. The combustion segment 130C grows as the combustion piston 230 moves towards the crankcase 105 as the purge segment 130P decreases, and vice versa.

Figure 6:
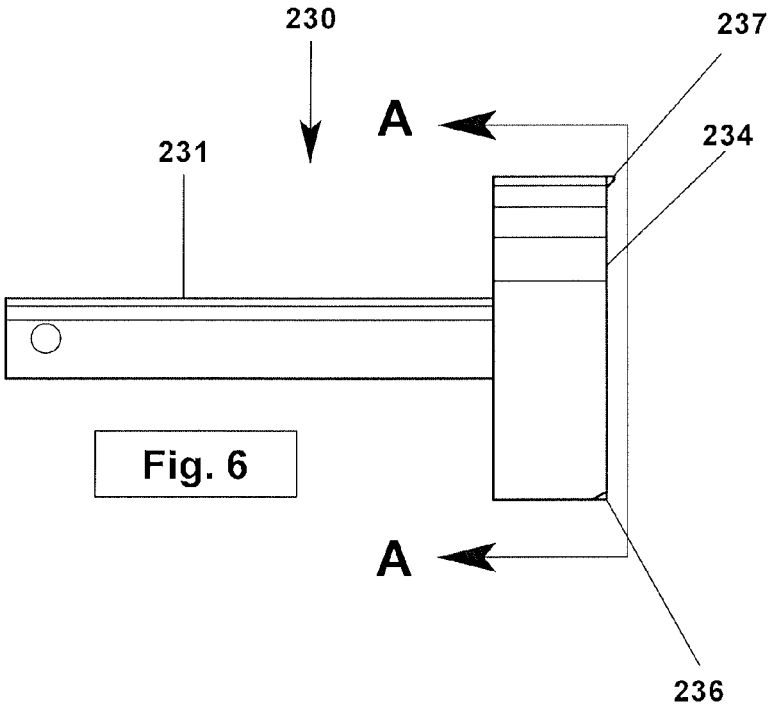
FIG. 6 is a plan side view of a combustion piston face of the Scotch yoke assembly according to an aspect.
Figure 6A:
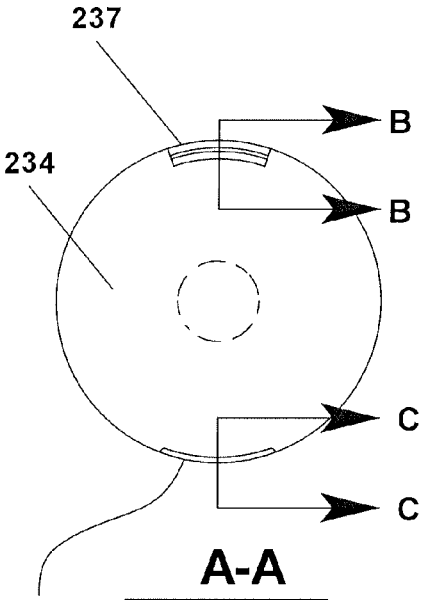
FIG. 6A is a front plan view of the combustion piston face of FIG. 6*a* along line A-A.
Figure 6B:
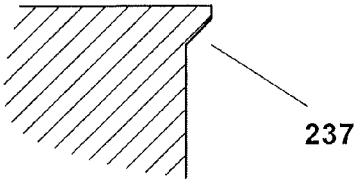
FIG. 6B is a cross-sectional view of the combustion piston face of FIG. 6*a* along line B-B.
Figure 6C:
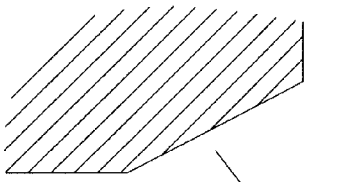
FIG. 6C is a cross-sectional view of the combustion piston face of FIG. 6*a* along line C-C.

The Scotch yoke base 205 includes a slotted raceway 206 that provides a slot for which a bearing assembly 350 can transmit combustion forces from the combustion pistons 230 to a crankshaft assembly 300, discussed in detail below. Since the combustion pistons 230 are dissected by the Scotch yoke base 205, a piston connecting rod 231 is required for each side (A, B) of the opposed-piston engine 100. In an aspect, the faces 234 of the combustion piston heads 230*a* include a purge recess 236 and an intake lip 237, as shown in FIGS. 6 and A-C. In such aspects, the purge recess 236 is configured to align with the purge port 138, whereas the intake lip 237 is configured to align with the intake port 137. The purge recesses 236 and the intake lips 237 are configured to ensure that the intake port 137 and the purge port 138 do not open at the same time, which would negate their intended purposes.

Figures 8, 9:
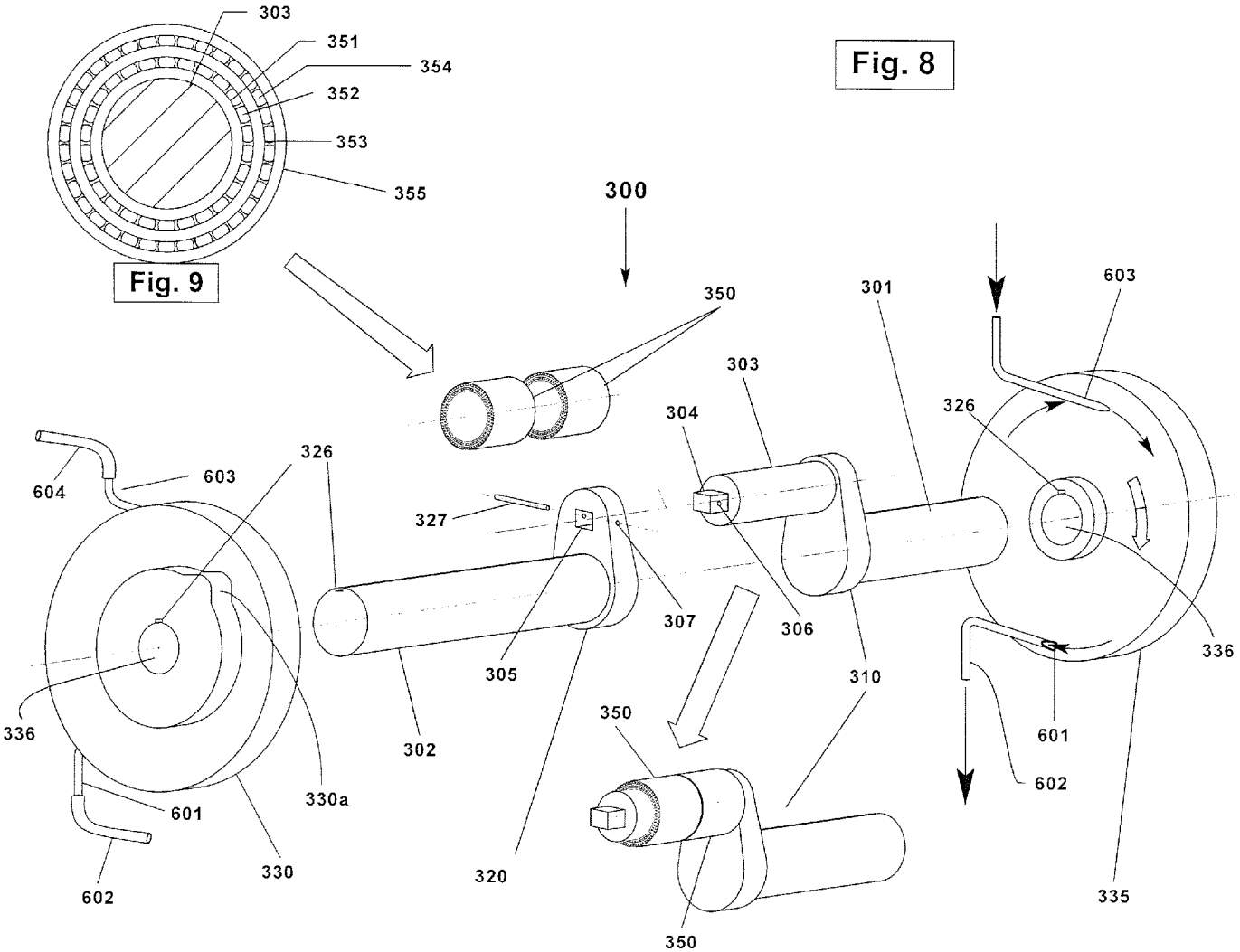
FIG. 8 is an exploded view of a crankshaft assembly of the two cylinder, two cycle opposed-piston engine of FIG. 1 according to an aspect.
FIG. 9 is a cross-sectional view of a multi-element bearing of the crankshaft assembly of FIG. 8.

In an aspect, as shown in FIGS. 7-9, the Scotch yoke base 205 is configured to engage a crankshaft assembly 300. In an aspect, the crankshaft assembly 300 and its components can be isolated within the crankcase 105, and not extend into the cylinders 110, 130 and accumulator chambers 120 of the engine sections 101, 102. By isolating the crankshaft assembly 300 from the cylinders 110, 130 and chambers 120, lubricant 605 (discussed below) for the crankshaft assembly 300 is also isolated from the combustion and purging cycles of the engine, eliminating the mixture of the lubricant from the fuel during combustion and reducing harmful exhaust emissions.

Figure 17:
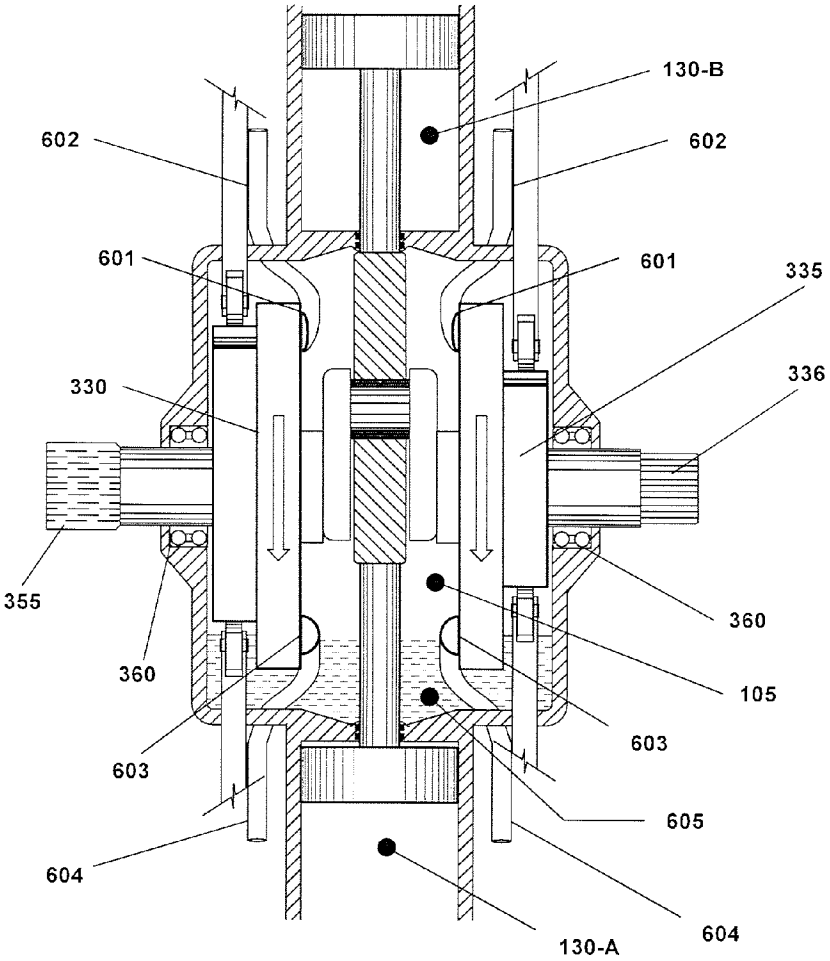
FIG. 17 is a partial top cross-sectional view of a crankcase of the two cylinder, two cycle opposed-piston engine of FIG. 1 detailing the lubrication process according to an aspect.

The crankshaft assembly 300 can be mated to the engine case 104 through two main bearings 360, as shown in FIG. 17. In an aspect, the crankshaft assembly 300 includes a detonator main journal 301, an exhaust main journal 302, and a rod journal 303, wherein the rod journal 303 is configured to connect the detonator and exhaust main journals 301, 302. In an aspect, the rod journal 303 is configured to receive a bearing assembly 350, discussed in detail below. In an aspect, the rod journal 303 is connected to the detonator main journal 301 and exhaust main journal 302 through a detonator support 310 and an exhaust support 320 respectively, as shown in FIG. 8. In an exemplary aspect, the rod journal 303, detonator support 310, and detonator main journal 301 can be permanently secured to one another, with the exhaust main journal 301 and exhaust support 320 being permanently secured to one another. For example, these components can be machined to form respective solid single bodies. In an aspect, the rod journal 303 can include a rod tab 304 configured to engage a rod journal slot 305 found within the exhaust support 320 for assembly purposes, as shown in FIG. 8. In an exemplary aspect, the slot 305 and tab 304 can be configured to have aligning apertures 306, 307 respectively to receive a locking pin 327 to further secure the exhaust main journal 302 and support 320 to the rod journal 303 and detonator support 310 and main journal 301. This configuration allows for one or more bearing assemblies 350 to be installed before the crankshaft assembly 300 is fully assembled. The crankshaft assembly 300 can be joined and/or formed in other ways as long as it is possible to install the bearing assembly 350 on the rod journal.

In an aspect, the ends of the crankshaft assembly 300 include flywheels 330, 335. Like most of the components of the crankshaft assembly 300, the flywheels 330, 335 are contained within the crankcase 105. In an aspect, the end of the detonator main journal 301 opposite the rod journal 303 is configured to receive a detonator flywheel 335, as shown in FIG. 8. In an aspect, the detonator flywheel 335 is configured to include a cam 335*a*, shown in FIG. 10, which can be configured to operate with a detonator accumulator system 400, discussed in detail below. In an aspect, the end of the exhaust main journal 302 opposite the rod journal 303 is configured to receive an exhaust flywheel 330. In an aspect, the exhaust flywheel 330 is configured to include a cam 330*a*, shown in FIGS. 8 and 12, which can be configured to operate an exhaust system 500, discussed in detail below. In an aspect, the detonator flywheel 335 and the exhaust flywheel 330 can include apertures 336, 331 to receive the ends of the detonator main journal 301 and exhaust main journal 302 respectively. In addition, the ends of the detonator main journal 301 and exhaust main journal 302, along with the corresponding apertures 336, 331 can utilize a keyway system 326 (including a key and slot, the key not shown for clarity purposes) to assist in the alignment and coupling of the journals 301, 302 to the flywheels 335, 330.

In an aspect, the flywheels 335, 330 can be configured to pump lubrication to remote areas of the engine 100, described in detail below. In an aspect, the flywheels 330, 335 include lubrication pickup tubes 601 that are connected to pickup hoses 602. Likewise, the flywheels 335, 330 can include lubrication return tubes 603 connected to return hoses 604 aligned with a lubrication return hose 604, discussed in detail below. In an aspect, the crankshaft assembly 300 can also include means for transmitting rotational forces. In an exemplary aspect, the outside ends of the crankshaft assembly 300 can include a male spine 355 and a female spine 356, as shown in FIG. 17.

As shown in FIGS. 7-9, the crankshaft assembly 300 includes at least one bearing assembly 350. In an aspect, the bearing assembly 350 is configured to engage both the body of the rod journal 303 and the inner surface of the slotted raceway 206 of the Scotch yoke base 205, as shown in FIGS. 7 and 9. In an exemplary aspect, the crankshaft assembly 300 can include one or more bearing assemblies 350 which help facilitate access to lubricant 605 circulating within the crankcase 105, discussed in detail below.

In an aspect, the bearing assembly 350 comprises three races: an inner race 351, a middle race 353, and an outer race 355, as shown in FIG. 9. In such aspects, the inner race 351 is separated from the middle race 353 and the middle race 353 is separated from the outer race 355 by two sets of rolling elements 352, 354. The two sets of rolling elements 352, 354 can include, but are not limited to, needle and/or ball bearings. The rolling elements 352, 354 assist in reducing friction. In an exemplary aspect, the inner surface of the inner race 351 is configured to engage the outer surface of the rod journal 303 while the outer surface of the outer race 355 engages the inner surface of the slotted raceway 206. This configuration allows the bearing assembly 350 to transmit the combustion force applied to the Scotch yoke base 205 by the combustion pistons 230 to the crankshaft assembly 300. While FIGS. 7 and 9 illustrate a bearing assembly 350 having three races 351, 353, 355 and two sets of rolling elements 352, 354, bearing assemblies 350 of other aspects can include additional races and sets of rolling elements. Such a combination allows for high speed rotation while providing a back-up rolling element component in case a bearing begins to fail. In an aspect, the rolling elements 352, 354 assist in the free rotation of the rod journal 303 while transferring the force received from the Scotch yoke base 205.

Figure 10:
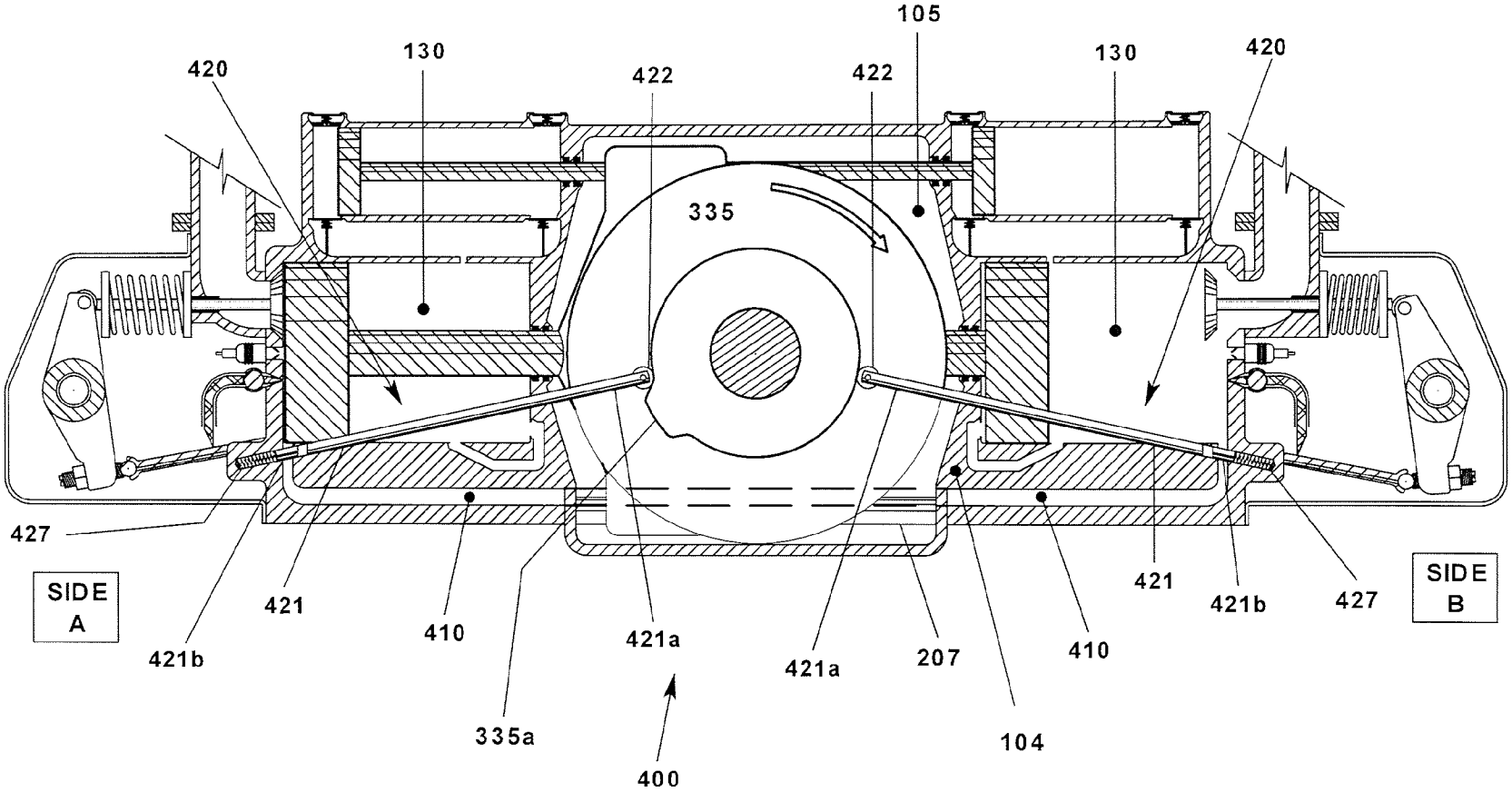
FIG. 10 is a cross-sectional side view of the two cylinder, two cycle opposed-piston engine from a detonator accumulator system side according to an aspect.
Figure 11:
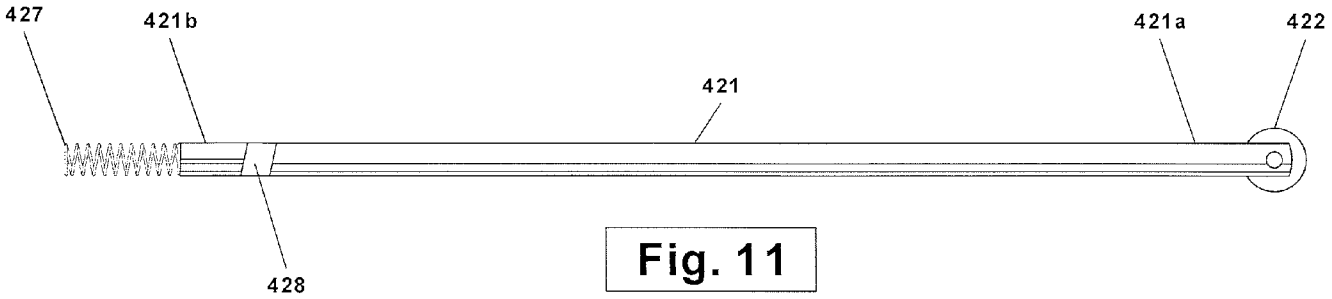
FIG. 11 is a plan side view of a component of the detonator accumulator system of FIG. 10 according to an aspect.

As discussed above, the detonator flywheel 335 is configured to operate with a detonator accumulator system 400, shown in FIGS. 10-11. In an aspect, the detonator accumulator system 400 includes a cam 335*a* located on the flywheel 335, a detonation accumulator chamber 410 and a detonation accumulator valve assembly 420. In an aspect, the cam 335*a* can include, but is not limited to, lobe, a disc cam, a plate cam, radial cam or the like. In an aspect, the cam 335*a* can be integrally formed with the detonator flywheel 335 or secured through other known means. In an aspect, the detonation accumulator chamber 410 is formed within the engine case 104, and is in communication with both combustion cylinders 130 of the opposed-piston engine 100. The detonation accumulator chamber 410 is further configured to retain high temperature, high pressure gases, discussed in detail below.

Figure 11A:
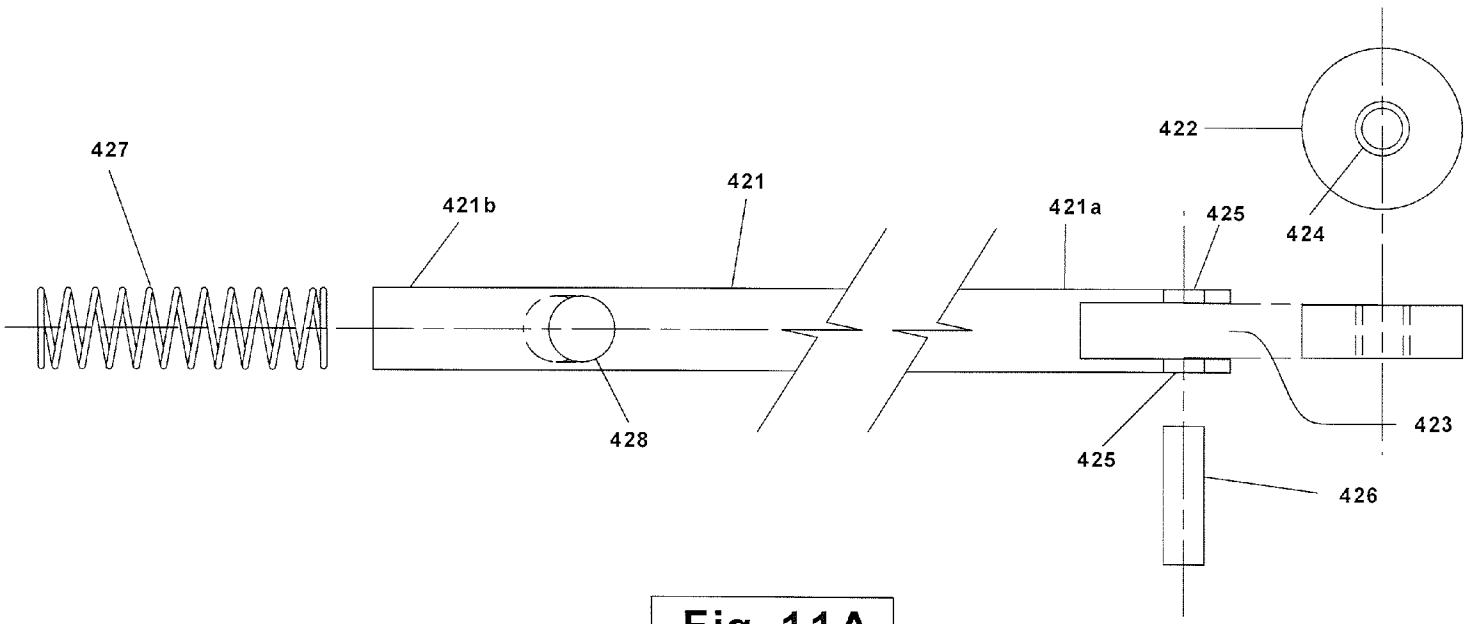
FIG. 11A is a partial exploded schematic view of the component of FIG. 11.

As illustrated in FIGS. 10-11A, the detonation accumulator valve assembly 420 is configured to control the release and collection of the gases from the detonation accumulator chamber 410 into the combustion cylinders 130. The detonation accumulator valve assembly 420 is configured to operate within the crankcase 105 and the detonation accumulator chamber 410 while keeping both separated from one another. In an aspect, the detonation accumulator valve assembly 420 includes a push rod 421. In an aspect, the engine case 104 is configured to have channels (not shown for clarity) that receive the push rod 421 between the crankcase 105 and the detonation accumulator chamber 410, which can include bearing and seals to create a seal between the crankcase 105 and detonation accumulator chamber 410. The push rod 421 includes a cam end 421*a* and a chamber end 421*b*. The cam end 421*a* of the push rod 421 is configured to engage the cam 335*a* of the detonator flywheel 335. In an aspect, the cam end 421*a* of the push rod 421 is configured to receive a cam follower 422. The cam end 421*a* of the push rod 421 can be configured to have a slot 423 to receive the cam follower 422. The cam follower 422 can include a bearing 424 that corresponds in size to apertures 425 on the cam end 421*a* of the push rod 421, all of which are configured to receive a retention pin 426 to retain the cam follower 422 within the slot 423. The cam follower 422 is configured to engage the cam 335*a* of the detonator flywheel 335 as the flywheel 335 rotates.

The chamber end 421*b* of the push rod 421 is configured to receive a return spring 427. In an aspect, the return spring 427 is coupled to the engine case 104, as shown in FIG. 10, as well as the chamber end 421*b* of the push rod 421. In an aspect, the push rod 421 includes a detonation aperture 428 approximate the chamber end 421*b*. When the return spring 427 is fully extended (i.e., not compressed), the detonation aperture 428 is not aligned with the detonation accumulator chamber 410. When the cam 335*a* of the detonator flywheel 335 engagingly presses the cam end 221*b*, and more specifically the cam follower 422, of the push rod 421, the detonation accumulator valve assembly 420 is configured to align the detonation aperture 428 with the end of the detonation accumulator chamber 410 adjacent the combustion cylinder 130 to allow the hot and pressurized mixed gases into the combustion cylinder 130. The detonation aperture 428 is also configured to stay open to allow re-charging of the detonation accumulator chamber 410 as the fuel/air detonation takes place in the combustion cylinder 130 in the combustion segment 130-C.

Figure 12:
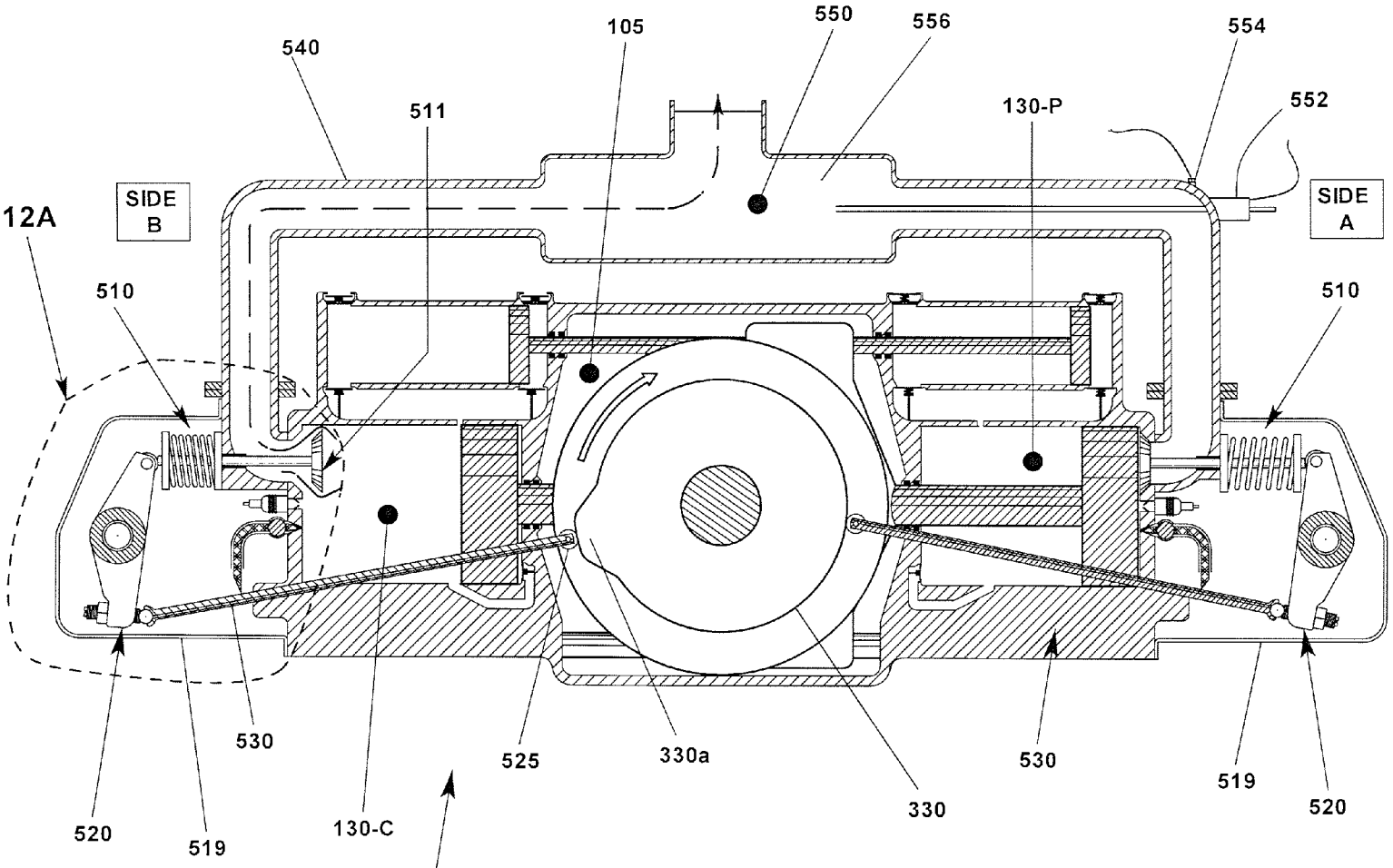
FIG. 12 is a cross-sectional side view of the two cylinder, two cycle opposed-piston engine of FIG. 1 from an exhaust system side according to an aspect.

As discussed above, the exhaust flywheel 330 is configured to operate with an exhaust system 500, shown in FIGS. 12-17. In an aspect, the exhaust flywheel 330 can include a cam 330*a*. In an aspect, the cam 330*a* of the exhaust flywheel 330 can comprise the same types of cams 335*a* of the detonator flywheel 335 discussed above. In an aspect, components of the exhaust system 500 can be retained within a valve cover 519, as shown in FIG. 12. In an aspect, the exhaust system 500 comprises an exhaust valve assembly 510, a rocker arm assembly 520, a push rod assembly 530, and an exhaust manifold 540. In an aspect, the exhaust flywheel 330 operates the exhaust valve assembly 510 through the rocker arm assembly 520 and the push rod assembly 530.

Figure 12A:
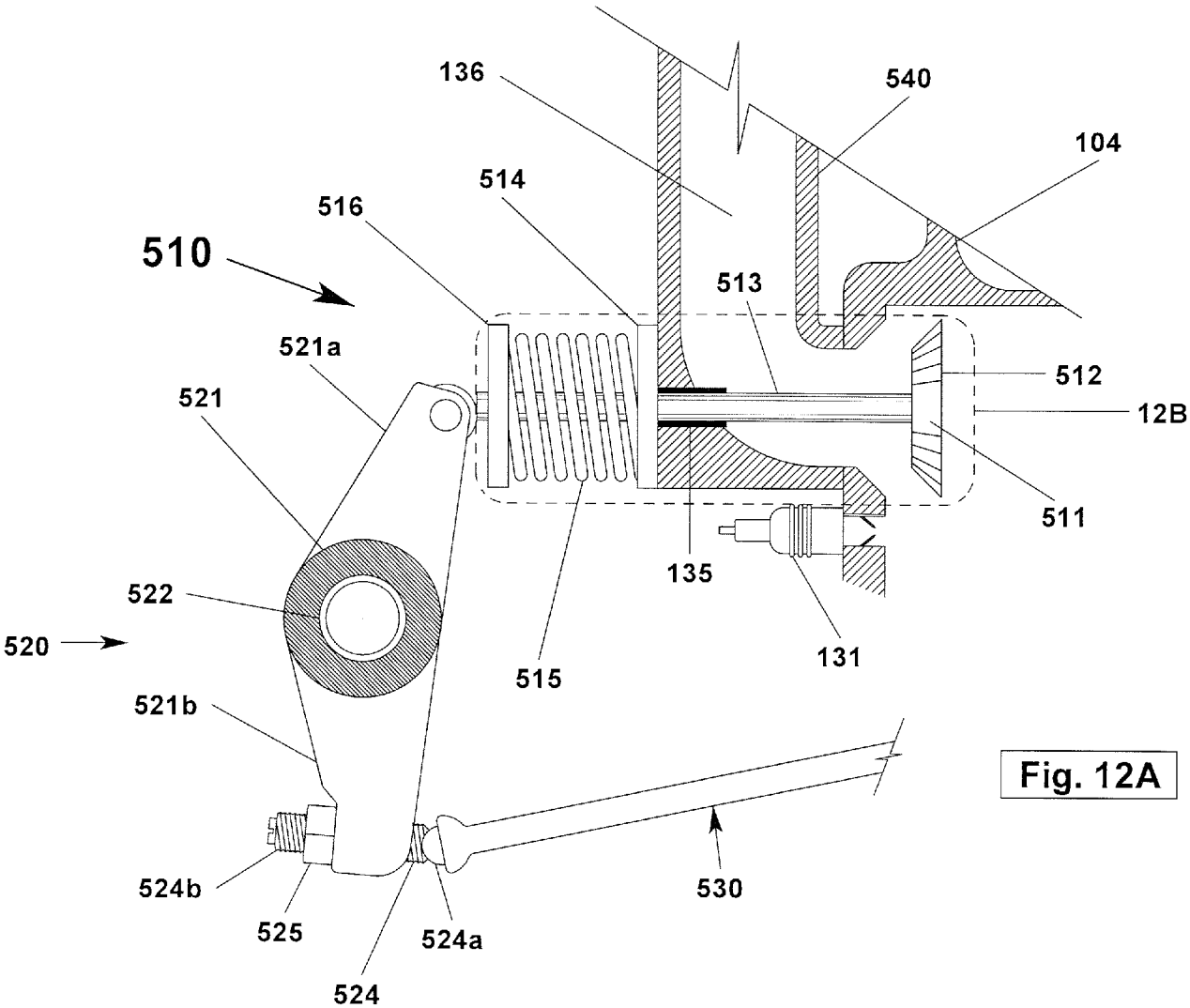
FIG. 12A is a cross-sectional view of an exhaust valve assembly of the exhaust system of FIG. 12.
Figure 12B:
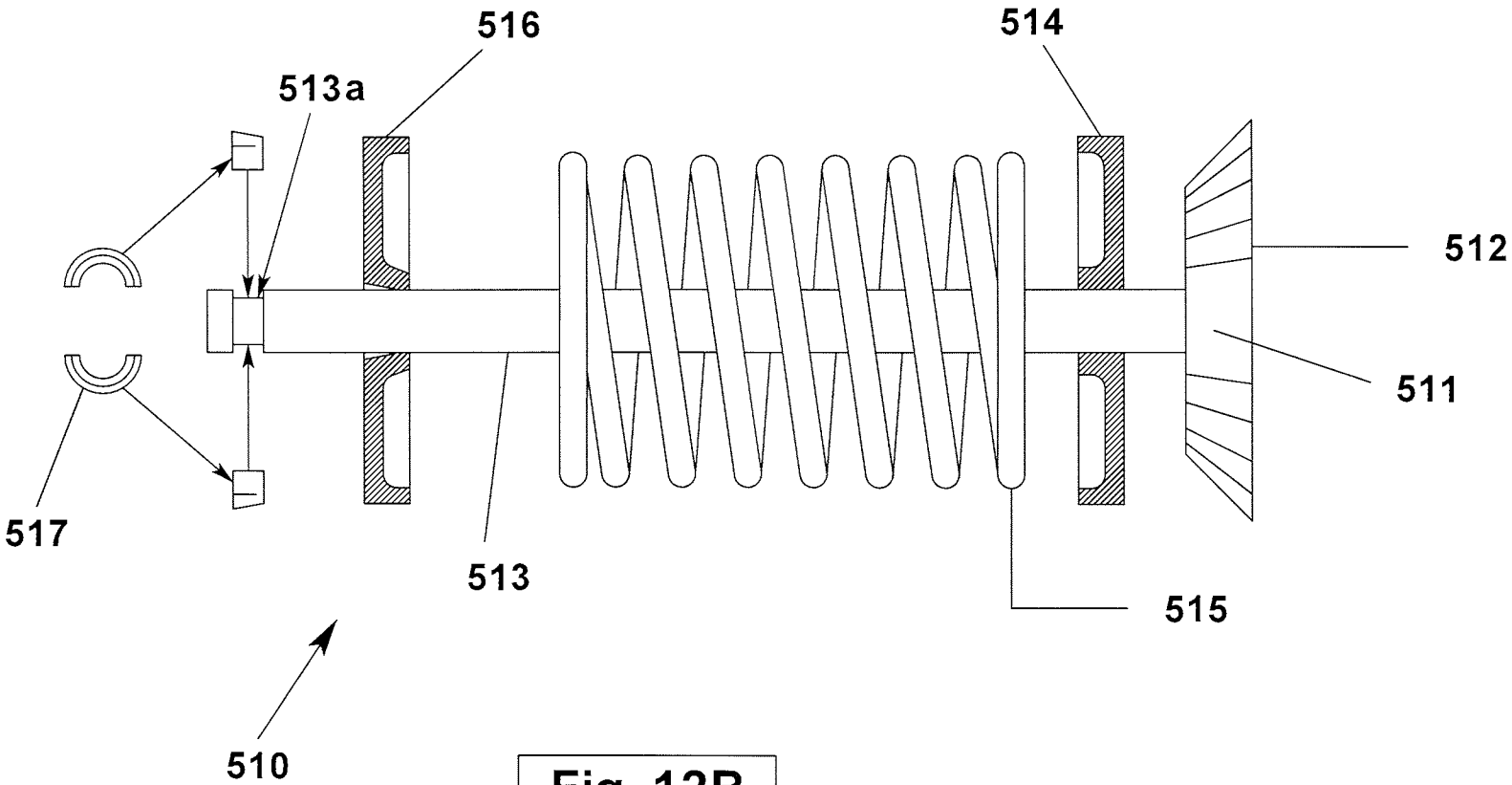
FIG. 12B is a cross-sectional view of an exhaust valve of FIG. 12B.

As shown in FIGS. 12A, 12B, 13, 13A, 14, and 14A, the valve assembly 510 comprises a valve 511, a valve spring base 514, a valve spring 515, and a valve spring retainer 516. The valve 511 can include a valve head 512 connected to a stem 513. As discussed above, an exhaust valve guide 135 extending through a wall of the engine case 104 is configured to guide the stem 513 of the valve 511 within the exhaust port 136. The valve spring base 514 is anchored on the exterior of the engine case 104 opposite the exhaust port 136. In combination, the valve spring base 514 and the valve spring retainer 516 are configured to retain the valve spring 515 on the end of the stem 513 of the valve 511. In an aspect the valve spring retainer 516 can be secured at the end of the stem 513 opposite the head 512 of the valve 511 through valve spring keepers 517, which can be received within notches 513*a* on the end of the stem 513, as shown in FIG. 12*b*. In an exemplary aspect, valve spring base 514 and retainer 516 can include respective recesses 514*a*, 516*a* that are further configured to retain the valve spring 515, as shown in FIGS. 13, 13A, 14, and 14A.

Figure 15:
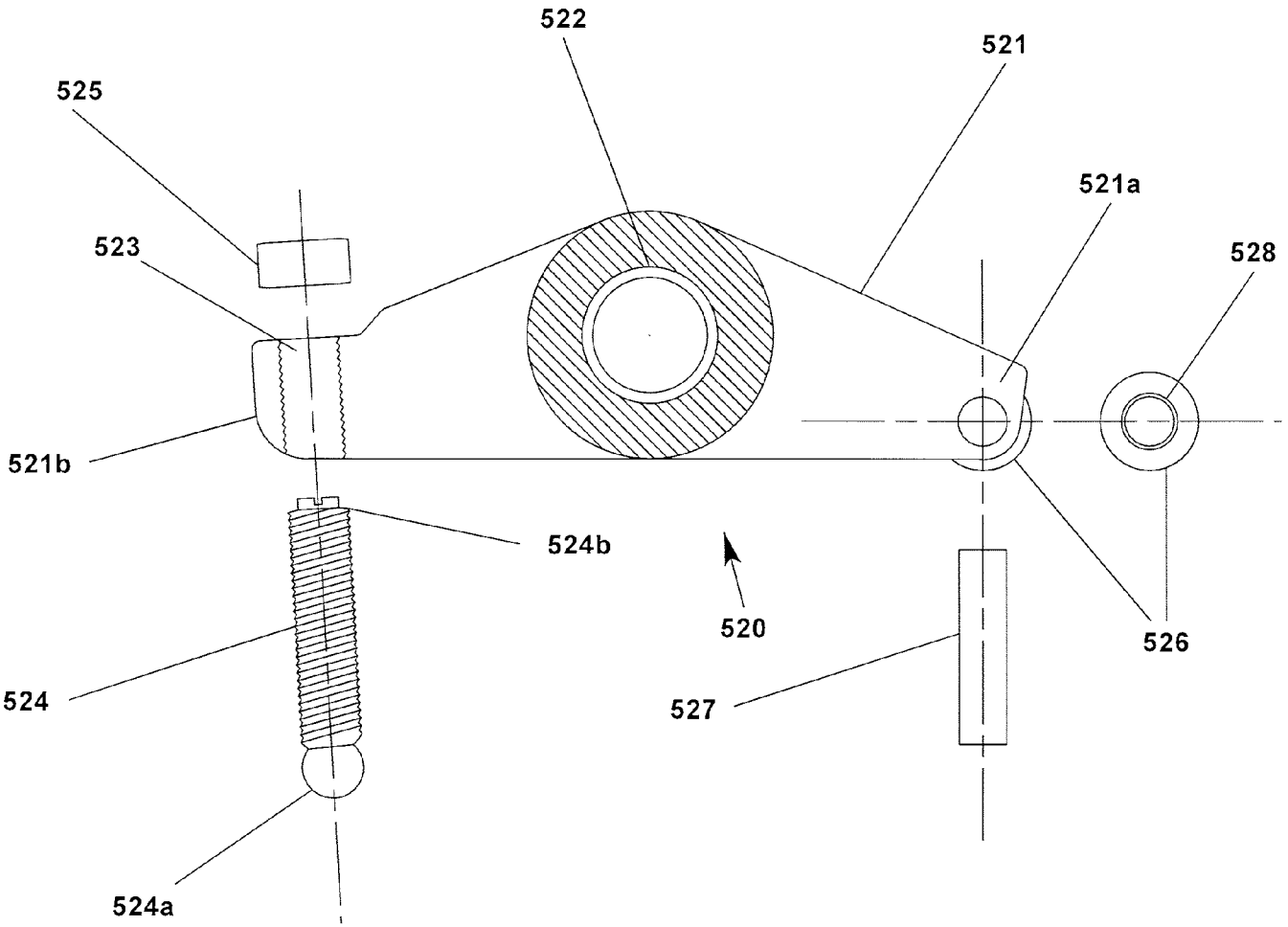
FIG. 15 is a cross-sectional exploded view of a rocker arm assembly of the exhaust system of FIG. 12.
Figure 16:
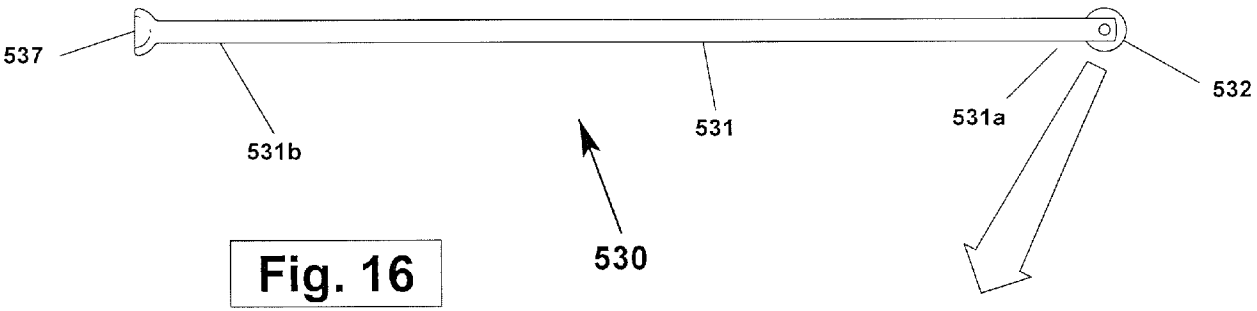
FIG. 16 is a plan side view of a valve actuation push rod of the exhaust system of FIG. 12.
Figure 16A:
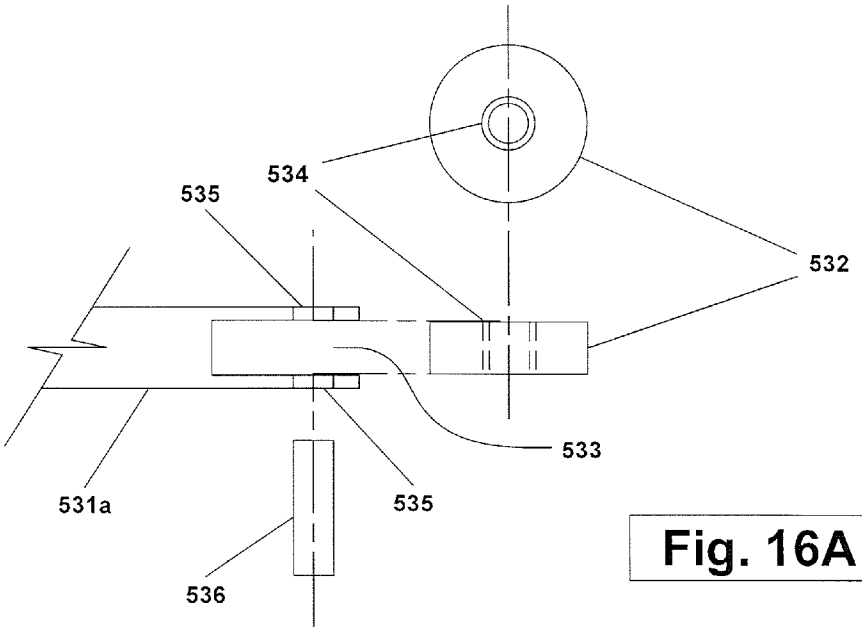
FIG. 16A is a partial exploded view of components of the valve actuation push rod of FIG. 16.

The valve spring assembly 510 is configured to be controlled by the rocker arm assembly 520 and push rod assembly 530. In an aspect, the rocker arm assembly 520 is configured to engage the push rod assembly 530. The rocker arm assembly 520 includes a rocker arm 521. The rocker arm 521 includes a valve end 521*a* and a rod end 521*b*. The middle of the rocker arm 521 includes a bearing 522 configured to engage a pivot point (not shown for clarity purposes) within the valve cover 519. In an aspect, the rod end 521*b* of the rocker arm 521 includes an adjustment aperture 523 that is configured to receive an adjustment pivot 524, as shown in FIGS. 12A and 15. The adjustment pivot 524 can include a rod end 524*a* configured to engage the push rod assembly 530. In an exemplary aspect, the rod end 524*a* can be formed to engage the rod 530. A lock nut 525 can secure the adjustment pivot 524 on the end opposite the rod end 524*a*. The adjustment pivot 524, adjustment aperture 523, and the lock nut 525 can include corresponding threaded surfaces, which assist in precision adjustment of the adjustment pivot 524.

The push rod assembly 530 is configured to interact with the exhaust flywheel 330 and the rocker arm assembly 520, as shown in FIGS. 12, 12*a*, and 15-16. In an aspect, the push rod 531 is similar to the push rod 421 associated with the detonator flywheel 335, and is configured to reach into the crankcase 105 and the valve cover area 519 while keeping the two areas isolated from one another. In such aspects, the engine case 104 can include annular channels, bearings and seals to assist in the isolation.

The push rod 531 includes a cam end 531*a* and a pivot end 531*b*. The cam end 531*a* of the push rod 531 is configured to engage the cam 330*a* of the exhaust flywheel 330. In an aspect, the cam end 531*a* of the push rod 531 is configured to receive a cam follower 532. The cam end 531*a* of the push rod 531 can be configured to have a slot 533 to receive the cam follower 532. The cam follower 532 can include a bearing 534 that corresponds in size to apertures 535 on the cam end 531*a*, all of which are configured to receive a retention pin 536 to retain the cam follower 532 within the slot 533. The cam follower 532 is configured to engage the cam 330*a* of the exhaust flywheel 330 as the flywheel 330 rotates. The pivot end 531*b* of the push rod 531 is configured to engage the end 524*a* of the adjustment pivot 524. In an exemplary aspect, the pivot end 531*b* can include an indention 537 that corresponds with the shape of the rod end 524*a* of the pivot 524.

As shown in FIGS. 12*a* and 15, the valve end 521*a* of the rocker arm 521 is configured to interact with the valve assembly 510. The valve end 521*a* can be configured to receive a cam follower 526 that is configured to engage the stem 513 of the valve 511. The cam follower 526 is secured to the valve end 521*a* of the rocker arm 521 with a retention pin 527. The cam follower 526 can be configured to receive a cam bearing 528 to assist in the rotation of the cam follower 527 around the retention pin 527 as the follower 526 engages the stem 513 of the valve 511.

When the cam 330*a* of the exhaust flywheel 330 engages the cam end 531*b*, and more specifically the cam follower 532, of the push rod 531, the pivot end 531*b* of the rod 531 pushes the adjustment pivot 524, which engages the stem 513 of the valve 511 while compressing the spring 514, forcing the exhaust valve 511 to open within the exhaust port 136, allowing exhaust to exit the combustion cylinder 130 through the exhaust port 136.

As shown in FIGS. 12 and 12A, the exhaust manifold 540 is connected to the upper portion of the combustion chamber 130, and is configured to pass exhaust out of the combustion chamber 130. The exhaust manifold 540 can be formed separately from the engine case 104 and coupled to the engine case 104 through known means.

In an aspect, the exhaust manifold 540 can include noise cancelling exhaust elements which include, but are not limited to, a tuning chamber 550, a tuning actuator 552, exhaust sensors 554, and an active tuning element 556. The combination of these elements work together to reduce the overall noise produced by the exhaust. For example, the tuning chamber 550 can be of a size that is big enough to absorb the exhaust pressure wave from one engine segment 101 of the opposed-piston engine 100 and slow the velocity of the exhaust pressure wave in time to allow an exhaust pressure wave from the other engine segment 102 to arrive and reduce the velocity of the second wave as well, allowing the waves to then make the turn to exit, thus absorbing the sound energy. In addition, since components of the opposed-piston engine 100 operate according to diesel engine principles, the exhaust gases have a slower exit velocity than spark ignited exhaust because all of the energy expended inside the combustion chamber 130: the spark ignited exhaust gases are still burning fuel as they exit the exhaust port 136, which can add to the noise.

As stated earlier, the opposed-piston engine 100 is dependent on the lubrication of its components. The lubrication of the various components of the opposed-piston engine 100 is dependent on the configuration of the engine case 104, to limit free space away from the two uniquely internal flywheels 330, 335. The engine case 104 is configured to isolate the compression cylinders 110 and combustion cylinders 130, which do not need lubrication due to the inviscid layer seal, from the crank case enclosure 105.

Figure 18:
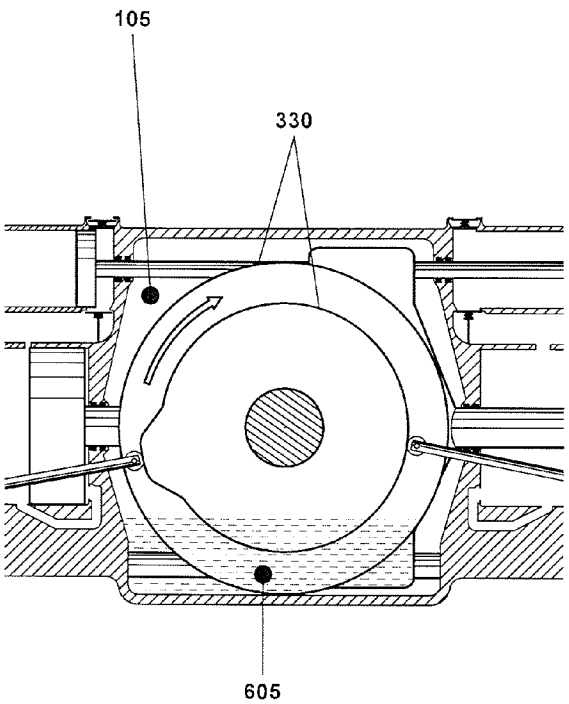
FIG. 18 is a cross-sectional side view of the exhaust cam flywheel of the two cylinder, two cycle opposed-piston engine partially immersed in lubricant according to an aspect.

A lubricant 605 can be introduced into the crankcase 105 of the engine, as shown in FIGS. 17-18. The lubricant 605 can lubricate the components of the crankshaft assembly 300. In an aspect, a sufficient amount of the lubricant 605 is introduced such that the edges of the detonation flywheel 335 and exhaust flywheel 330 are run-through the lubricant 605. In an aspect, as the flywheels 330, 335 are introduced into the lubricant 605, a portion of the lubricant 605 is vaporized due to the parasitic drag (i.e. skin friction) between the lubricant 605 and the flywheels 330, 335. As a result, the vaporized lubricant (not shown) begins to fill the crankcase 105 in the areas of need.

In an aspect, the flywheels 330, 335 and their associated pickup tubes 601 and hoses 602 and return tubes 603 and hoses 604 utilize Bernoulli's principle to create a pressure differential which draws the lubricating mist/vaporized lubricant out of the crankcase 105 and to other areas of the opposed-piston engine 100. More specifically, a parasitic drag created at the flywheel/lubricant interface creates a pressure differential that circulates vaporized lubricant to the valve cover areas 519 in order to lubricate the exhaust valve assembly 510. As shown illustrated in FIG. 17, the non-cam side of the two flywheels 330, 335 include pickup tubes 601. The pickup tubes 601 are positioned to create high pressure through aliment such as to allow the high velocity lubricant vapor adhering to the surfaces of the flywheels 330, 335 to enter into the opening of the pickup tubes 601, facing the surface of the flywheels 330, 335, of the pickup tubes 601. The vapor is then transmitted through pickup hoses 602 to the valve cover area 519. In an aspect, the pickup hoses 602 can be configured to be received through corresponding apertures in the engine case 104. In other aspects, the pickup hoses 602 can be configured to be attached to the exterior surface of the engine case 104 of the opposed-piston engine 100.

The set of return tubes 603 and return hoses 604 are utilized to circulate the lubricating vapor back to the crankcase 105 from the area of the valve cover 519. In an aspect, the return tubes 603 and return hoses 604 are aligned such as to draw the vapor through parasitic drag by facing the opening of the return tube 603 away from the direction of the rotation of the flywheels 330, 335 so as to create low pressure in the return tube 603 and return hose 604 from the valve cover area 510. The opening of the return hose 604 within the valve cover 519 is properly situated away from the delivery side to facilitate vapor circulation in the valve cover 519. In an aspect, the return hoses 603 can be configured to be received through corresponding apertures in the engine case 104. In other aspects, the return hoses 603 can be configured to be attached to the exterior surface of the engine case 104 of the opposed-piston engine 100.

Figure 20:
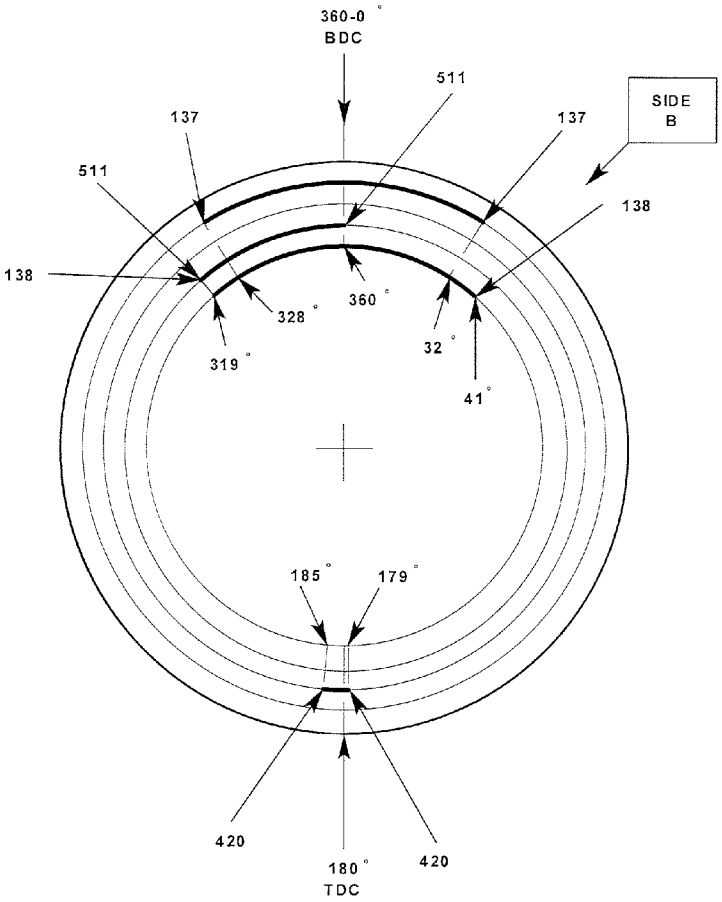
FIG. 20 illustrates the crankshaft angles at each point in the valve train operation for each revolution for side B which is 180 degrees out of phase with side A of the two cylinder, two cycle opposed-piston engine according to an aspect.
Figure 19:
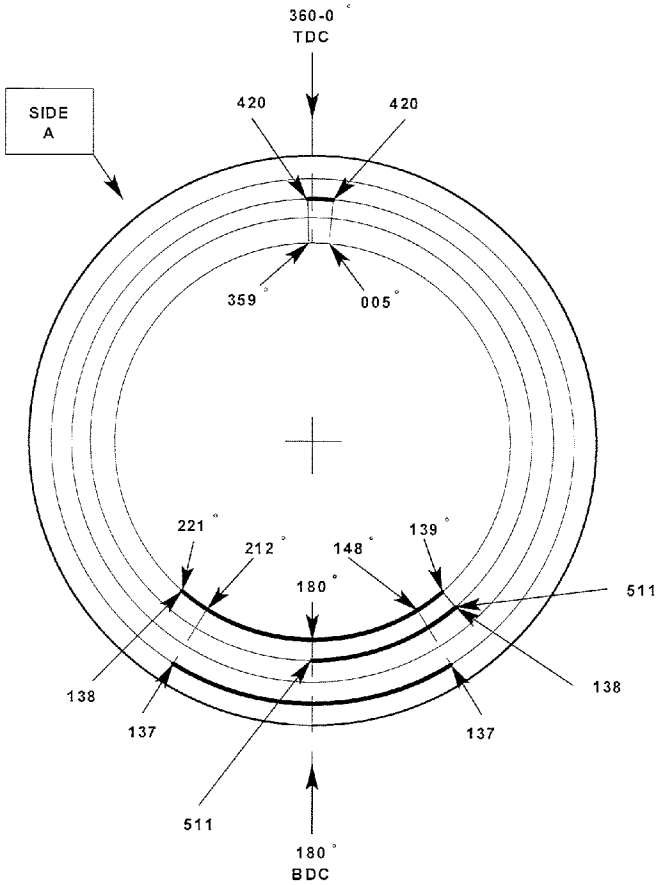
FIG. 19 illustrates the crankshaft angles at each point in the valve train operation of each revolution for side A of the two cylinder, two cycle opposed-piston engine according to an aspect.

In an aspect, the combustion and purge cycle of the opposed-piston engine operates in the following fashion. FIGS. 19-20 show the relative valve activation sequence with respect to the angle of the crankshaft assembly 300, with FIG. 19 showing the activation sequence for side A (section 101) and FIG. 20 showing the activation sequence for side B (section 102). As shown, and discussed above, both segments 101, 102 perform the same activities, but with the order of difference being 180 degrees of when the activities occur in relation to the position of the crankshaft assembly 300. For clarity, one side A of the opposed-piston engine 100 is described below, as the other side B is identical but is 180 degrees of crankshaft rotation offset from the first side.

The crankshaft angle sensor initiates the operation of the fuel injector 132, with the control module controlling the continuous operation of the spark plug 131 and fuel injector 132 until the control module is commanded to stop the operation fuel injector 132. The spark plug ceases to operate once the detonation accumulator chamber 410 is charged and the engine 100 can then operate through compression ignition.

As the air compression piston 210 travels back and forth in the compression cylinder 110, actuated by the actions of the Scotch yoke base 205 and the connecting rod 211, ambient air is drawn through the one-way intake check valves 115, shown in FIGS. 2 and 2A. The low pressure on the inside, combined with the higher pressure on the outside, cause the valve face 116 to depress the spring 117 against the spring support 118, which allows the passage of air into the compression cylinder 110. The action of the compression piston 210 repeats the action of the intake valve assembly 115 with the similar check valve assembly 125, shown in FIGS. 3 and 3*a*, into the accumulator chamber 120. The comparatively lower pressure on the inside of the compression cylinder 110 is now the higher pressure side of check valve assembly 125 and now combines with the lower pressure of the accumulator chamber 120, which now causes the valve face 126 to depress the spring 127 against the spring support 128, allowing the passage of air into the combustion chamber 130.

The intake port 137 between the accumulator chamber 120 and combustion cylinder 130 is properly sized and positioned to connect the two along the front side of the piston 230 during the combustion segment 130C and into the purge chamber 130P on the back side of the piston as it passes by in its circuit. As illustrated in FIG. 4, the combustion piston 230 passes the intake port 137, the compressed air from the air accumulator 120 passes into the combustion segment 130C of the combustion cylinder 130. As the combustion piston 230 begins to further compress the air which is now inside the combustion segment 130C of the combustion cylinder 130, the fuel injector(s) 132 begin(s) a series of short bursts of fuel for the length of the compression stroke, to insure a good mixture of the fuel with the air. As the piston 230 advances through the compression stroke, the head 230*a* passes the intake port 137 and the purge port 138, opening up the purge segment 130P to receive more compressed air from the air accumulator chamber 120, to be used later at the bottom of the power stroke to purge exhaust gases. Further, as the power stroke occurs to combustion piston 230 in one segment 101 (side A) of the opposed-piston engine 100, energy can be transmitted to the compression piston 210 of the compression cylinder 110 of the other segment 102 (side B) to super charge the second compression cylinder 110 (side B) with compressed air, which will then accumulate in the accumulation chamber 120 and eventually the combustion chamber 130 of the same side, resulting in more efficiency. In order to fill the accumulator chamber 120 with a full charge, the combination of the compression cylinder 110 and compression piston 210 needs to cycle back and forth one whole cycle/revolution while the combustion cylinder 130 needs only a half revolution to achieve its needed air load.

When the engine has run sufficiently to property charge the detonator accumulator system 400, the engine 100 will no longer have to rely on the spark plug 131 to remain running. Under operation of the detonator accumulator system 400, when the combustion piston 230 of segment 101 (side A) reaches the top of its stroke, at or past Top Dead Center (TDC), the components of the detonation accumulator valve assembly 420 associated with segment A (i.e., the push rod 421 extending into segment 101), opens and releases the stored high temperature and high pressure gases in the detonation accumulator 410, through the detonation aperture 428, into the combustion cylinder 130C, taking the fuel and air mixture past the point of detonation in the combustion cylinder 130C to begin the power stroke. The detonation accumulator valve assembly 420 keeps the detonation aperture 428 in place long enough to recharge the detonation accumulator chamber 410 in preparation for activation of the opposing engine section 102/side B. The use of the detonator accumulator system 400 creates a high compression ratio after TDC, without power loss due to high compression. The process can be repeated for both sides.

The push rod assembly 530 is actuated by the exhaust flywheel 330 which then pushes on the adjustment pivot 524 retained by the lock nut 525 to the rocker arm 521. The cam follower 526 on the other end 521*a* of the rocker arm 521 then actuates the exhaust valve 511. As the combustion piston 230 recedes through the power stroke, two events occur at the same time. The exhaust valve 511 opens at the top of the combustion cylinder 130, and more specifically the exhaust port 136, to allow the exhaust gases to escape into the exhaust manifold 540. At the same time, the purge recess 236 of the piston 230, see FIG. 6, is exposed to the purge port 138, allowing the compressed air at the back side of the piston 230 to emerge from the purge cylinder 130P as the piston 230 nears the bottom of its stroke to purge the exhaust gases from the combustion cylinder 130C. In an aspect, approximately nine or so degrees of crankshaft rotation later (see FIGS. 19-20), the piston intake lip 238 exposes the intake port 137 which allows an in-rush of compressed air to charge the combustion cylinder 130C with fresh air for the next revolution.

After the combustion piston 230 has minimized the purge segment 130P, the combustion piston 230 bottoms out and begins the return compression stroke. The combustion piston 230 passes by both the intake port 137 and the purge port 138, isolating them both from the combustion chamber 130 and opening both up to the air accumulator chamber 120, to be refilled with air for the next cycle. As the combustion piston 230 continues to compress its air load, the fuel injector 132 begins to inject multiple short burst of fuel into the combustion segment 130C, to facilitate even mixing of the fuel and air in preparation for detonation at the top of the stroke. This action repeats as necessary.

Figure 21A:
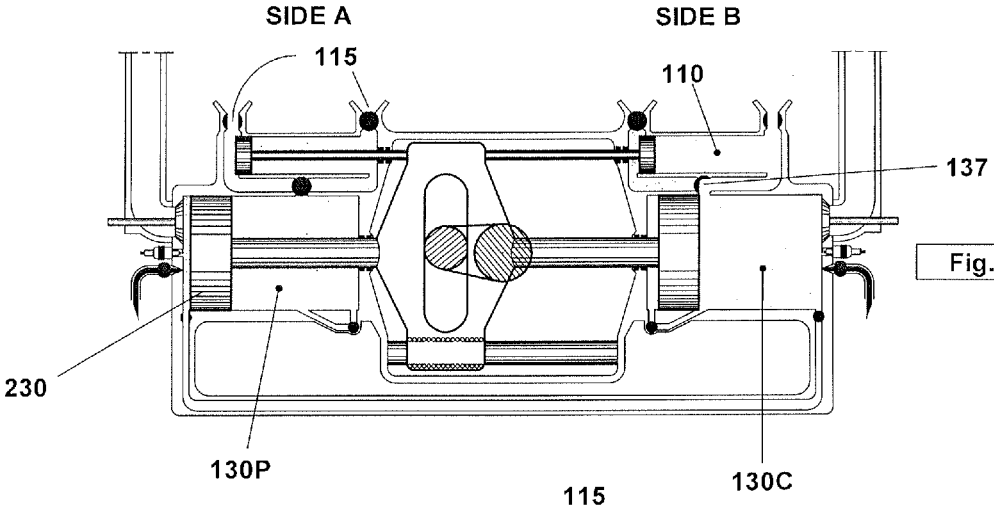
FIGS. 21A-F illustrate half a power cycle of the two cylinder, two cycle opposed-piston according to an aspect.

FIGS. 21A-F illustrate with more detail an exemplary aspect of a power cycle for one side B of the opposed-piston engine 100 and a purge cycle for the other side A. FIG. 21A shows the beginning of the combustion cycle for side B and the beginning for the purge cycle for side A. Supercharged air from the accumulator chamber 120 enters into the combustion segment 130C through the intake port 137 on Side B, since the air within the accumulator chamber 120 is at a higher pressure than the air within the combustion segment 130C. No compressed air enters into the purge segment 130P of Side A due to the combination of the check valve 125 (not shown) and the low pressure in the purge segment 130P.

Figure 21B:
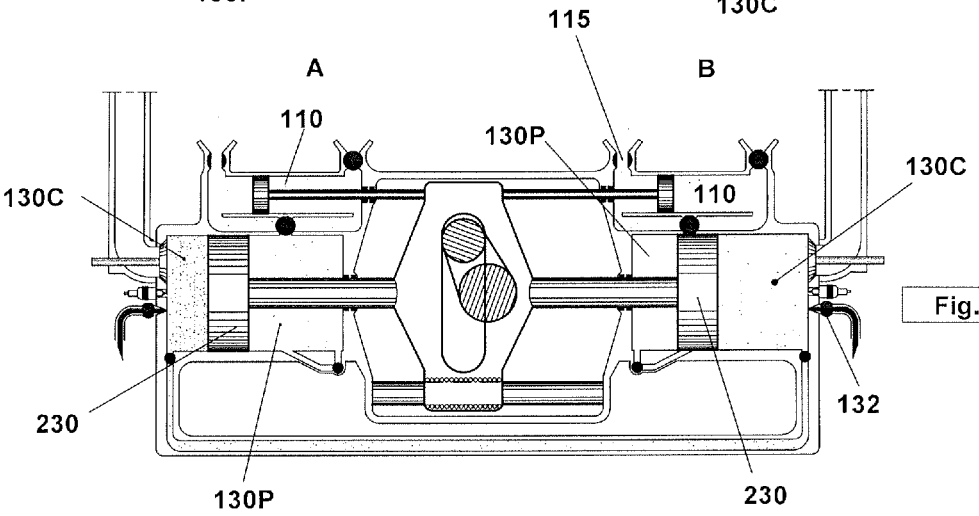

As shown in FIG. 21B, a crankshaft angle sensor initiates the operation of the fuel injector 132. In an aspect, the crankshaft angle sensor can be configured to pulse the fuel injector 132 to inject fuel into the combustion segment 130C of the combustion cylinder 130 as the combustion piston 230 compresses the air. The combustion piston 230 on Side A begins to compress air within the purge segment 130P, while the air within the combustion segment 130C becomes less pressurized. At the same time, the compression pistons 210, actuated by the Scotch yoke base 205, draw in ambient air through the one-way intake check valves 115 into the compression cylinders 110. The low pressure on the inside of the compression cylinders 110, combined with the higher pressure on the outside of the one-way check valve 115, cause the valve face 116 to depress the spring 117 against the spring support 118, which allows the passage of air into the compression cylinder 110.

Figure 21C:
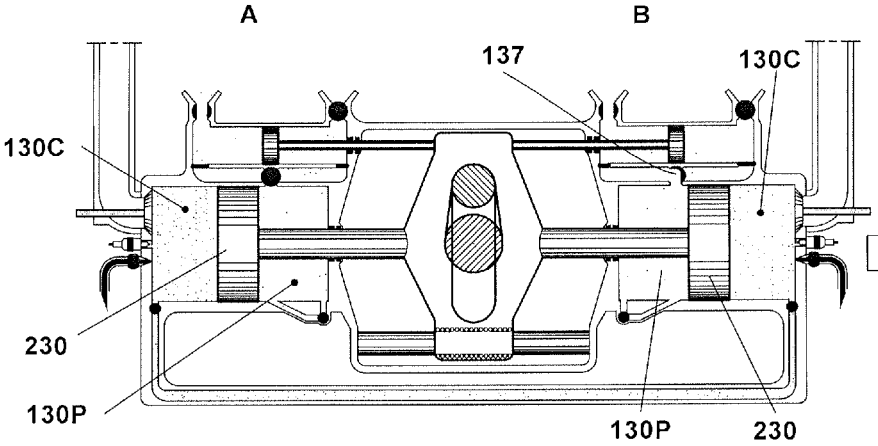

FIG. 21C shows the action of the compression cylinder 110 repeating the action of the intake valve assembly 115 with the similar check valve assembly 125 (shown in FIGS. 3 and 3*a*) the accumulator chamber 120. The comparatively lower pressure on the inside of the compression cylinder 110 is now the higher pressure side of check valve assembly 125 and now combines with the lower pressure of the accumulator chamber 120, which causes the check valve assembly 125 to allow the passage of air into the combustion cylinder 130 as the head 230*a* of the combustion piston 230 passes the intake port 137 of Side B. As a result, some compressed air from the accumulator chamber 120 can enter into the purge section 130P. The supercharged air already retained with the compression segment 130C on side A is further compressed and mixed with the fuel. On side A, the compressed air within the accumulator chamber 120 is contained as the pressure of the air within the purge segment 130P continues to increase.

Figure 21D:
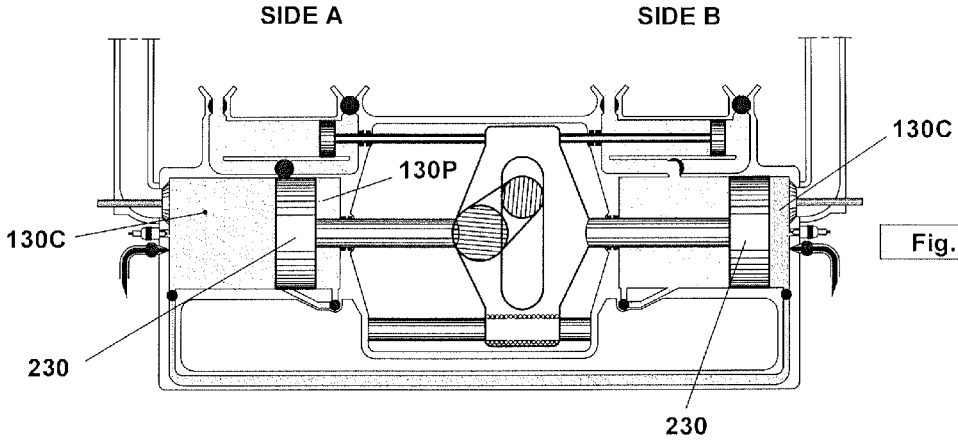

As shown in FIG. 21D, the intake port 137 is blocked by the head 230*a* of the combustion piston 230 on side A, continuing to build up the pressure within the purge segment 130P and the accumulator chamber 120. Likewise, on side B, the combustion segment 130C of the combustion cylinder 130 is further compressed. In addition, more fuel can be added to the charged mixture within the combustion segment 130C. Air can continue to enter into the purge segment 130P through the accumulator chamber 120 and compression cylinder 110.

Figure 21E:
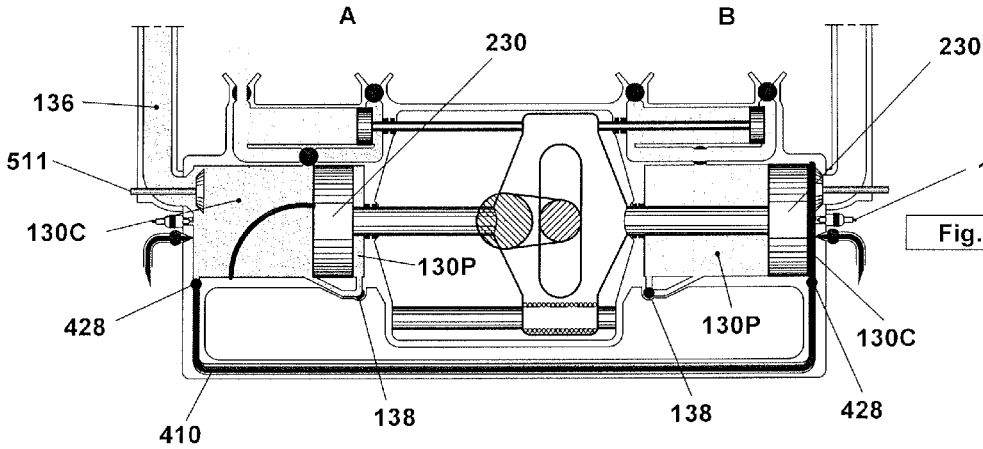
Figure 21F:
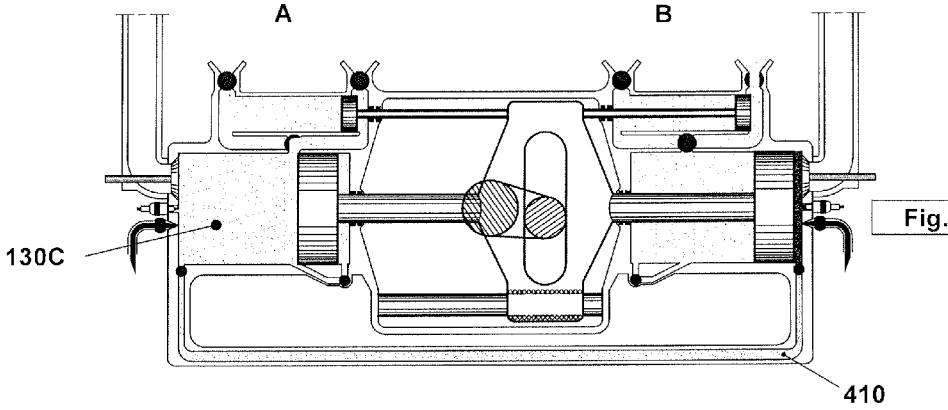

FIG. 21E illustrates the combustion of the charged fuel/air mix in the combustion segment 130C on side B. A spark plug 131 can be used to initiate the combustion. At the same time, the detonator accumulator system 400 can be activated to capture some of the high-temperature, high pressure gas by opening (positioning) the detonation aperture 428 to connect the combustion segment 130C and the detonation accumulator 410 on side B while keeping the accumulator 410 closed on side B. At the same time, exhaust valve 511 is opened within the purge segment 130P on the opposite side A, allowing exhaust from the previous power cycle on side A to escape through the exhaust port 136. At the same time, the combustion cylinder 230 passes the purge port 138, allowing the pressurized air that was retained within the purge segment 130P to be forced through the purge port 138, forcing more exhaust out the exhaust port 136 via the exhaust valve 511. Before the power cycle begins on side A, the detonation aperture 428 is recoiled, trapping the high temperature, high pressurized gases within the detonation accumulator 410 for use as described above, as shown in FIG. 21F. The preceding FIG. 21A through 21F are used to demonstrate fuel/air sequence and not mechanical actuation.

The opposed-piston engine 100 described above provides for several improvements and advantages over other internal combustion engines known in the art. By combining the elements of spark ignited engines and compression ignited engines, the opposed-piston engine 100 takes the best attributes. For example, the opposed-piston engine 100 incorporates the efficient valves and the lubricant-less fuel of a four stroke "Otto Cycle" engine, with the power to weight ratio and the cylinder firing on each revolution of a "two Stroke engine" and the high torque and fuel detonation of a diesel engine.

In an aspect, since the opposed-piston engine 100 utilizes a spark plug 131 until the detonation accumulator chamber 410 is fully charged, the opposed-piston engine 100 is configured to operate at lower pressure than a diesel engine, which allows the fuel injectors to work with more than one type of fuel (e.g., diesel and gasoline), due to the different apertures in the injectors. In addition, since the opposed-piston engine 100 is configured to operate at low pressures, the opposed-piston engine 100 is easier to start than a high compression diesel engine, due to the lower compression ratio. Further, the opposed-piston engine 100 can operate at higher torque at high speeds due to the double fuel/air load and the fact that the load is detonated just past TDC. Likewise, the opposed-piston engine 100 can have a wide range of speed for the same reasons. In an aspect, the opposed-piston engine 100 can operate from idle to 4,500 RPMs with the assembly described above. In other aspects, described in more detail below, the opposed-piston engine can operate from idle to 25,000 RPMs when using a high-speed exhaust valve system.

By utilizing a Scotch yoke 205 to connect the two opposed combustion pistons 230, the opposed-piston engine 100 can run in either direction and any orientation. As discussed above, by connecting the combustion cylinders 230 rigidly to the Scotch yoke 205, which is held ridged but sliding alignment through the connection rods 211, 231 and guide shaft 207, the heads 230*a* of the combustion pistons 230 are closely aligned with the walls of the combustion cylinders 130, forming an inviscid layer between the two. An inviscid layer forms whenever there is a dynamic surface in contact with a fluid (air or water, etc.). The faster the velocity differential between the solid surface and the fluid, the tougher and thicker the inviscid layer becomes.

In addition, as discussed above, the rigid connection of the connecting rods 231 to the pistons 230 and the Scotch yoke 205 eliminate the need for wrist pins and pivoting members (reducing overall parts of the engine), with which the inviscid layer would not be able to be formed. The rigid connection of the combustion pistons 230 to the Scotch yoke 205 also is more energy efficient as the energy normally lost as a result of a poor crankshaft angle, which comes from the wrist pin/pivot combination, is recovered. Further, configuration of the opposed-piston engine 100 reduces noise and vibration: the rigid connection of the combustion pistons 230 eliminates piston slap, and reduces the overall number of parts as well.

Noise can be further reduced based upon the exhaust system. Because the exhaust gases are at 180 degrees opposed, the exhaust gas pressure wave can be made to cancel out most noise through the tuning chamber 550 where the two exhaust channels of the exhaust manifold 540 join into one. Further, the exhaust system 500 does not create a back pressure and does not consume power, using the operation of the crankshaft assembly 300, and more specifically the exhaust cam flywheel 330, to operate the exhaust system 500.

The inviscid layer forms a near frictionless seal between the walls of the combustion cylinders 130 and the heads 230*s* of the pistons 230 without the need of piston seals, which increases the efficiency of the engine 100, since piston seals can increase friction. The inviscid seal also enables the backside of the head 230*a* of the combustion piston 230 to be utilized to compress air to be used to fully purge exhaust gases from the combustion cylinder 130. By fully purging the combustion cylinders 130, a cleaner burn of the fuel occurs. Further, since there is zero to very minimal contact between the surfaces of the walls of the combustion cylinders 130 and the heads 230*a* of the combustion pistons 230, no combustion cylinder lubrication is necessary. Without cylinder lubrication, friction is reduced within the combustion cylinder 130 and pollutants in the exhaust are reduced.

The opposed-piston engine 100 described above also eliminates the need of external cooling. First, as described above, the engine 100 has reduced friction in the combustion cylinders 130, which reduces heat production. In addition, heat from the combustion cycle is reabsorbed after the fuel is detonated, releasing all of its energy at the moment of detonation just past top dead center. As the piston 230 recedes, the gases expand, absorbing heat, known as a refrigeration cycle. In an aspect, the refrigeration cycle can be made more effective by extending the stroke of the engine. The refrigeration cycle can also reduce the heat of the exhaust gases.

Figure 31:
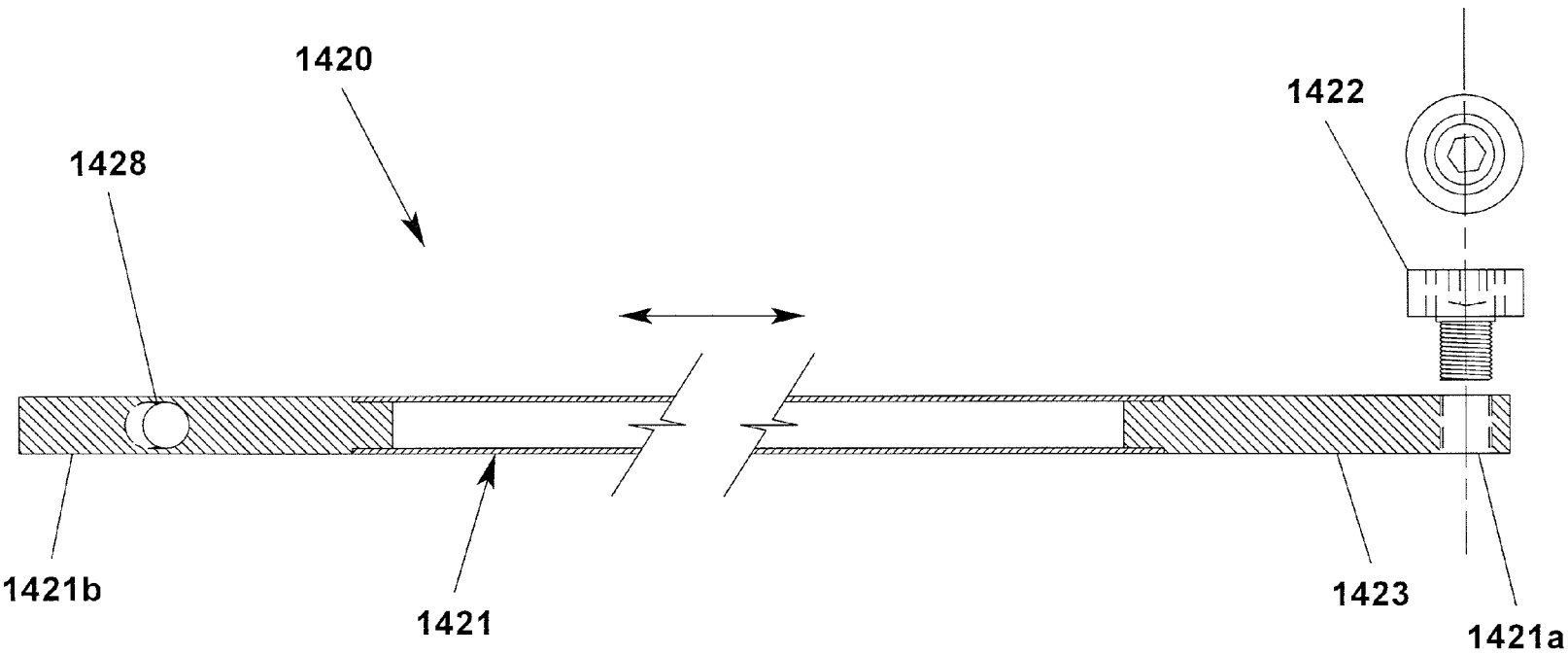
FIG. 31 is a cross-sectional view of a push rod of the detonator accumulator system according to an aspect.
Figure 32:
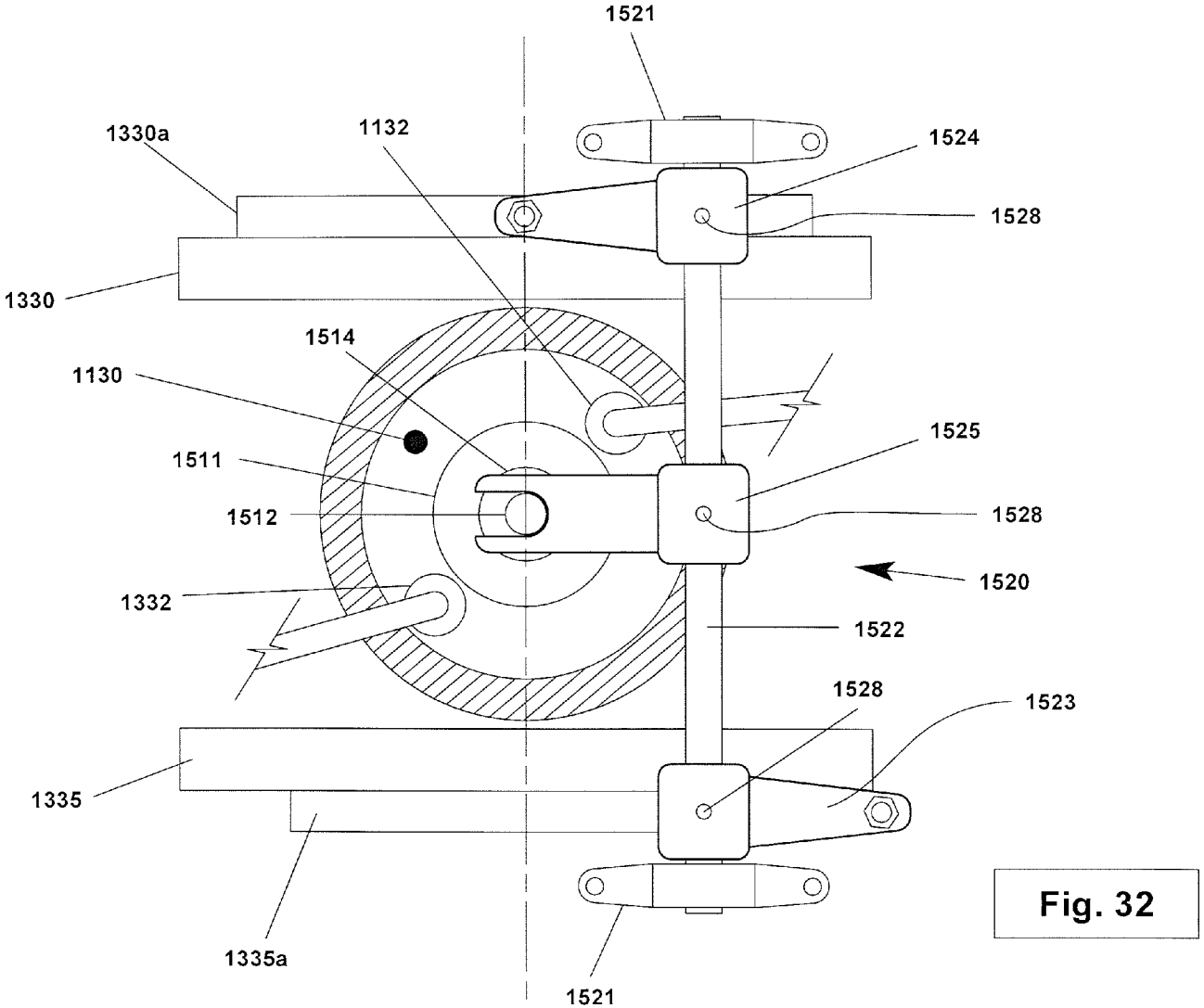
FIG. 32 is aside partial cross-sectional view of a combustion chamber and the high speed dual action valve train assembly according to an aspect.
Figure 33:
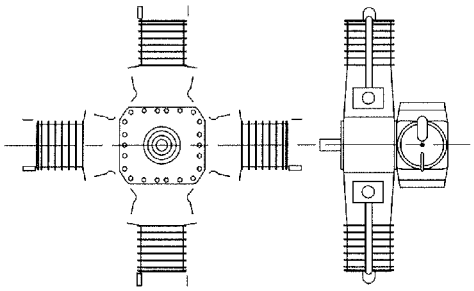
FIGS. 33-36 illustrate multiple combinations and orientations of a combination of two cylinder, two cycle opposed-piston engines.
Figure 34:
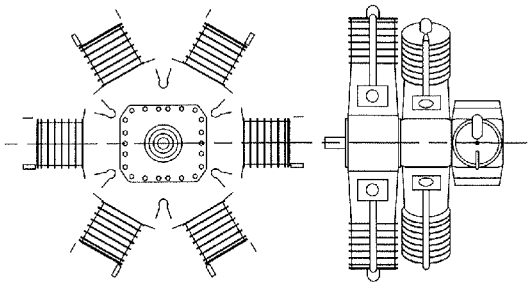
Figure 35:
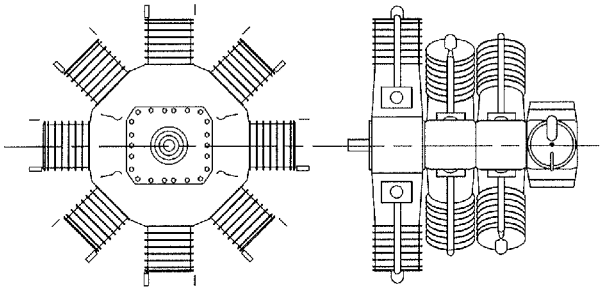
Figure 36:
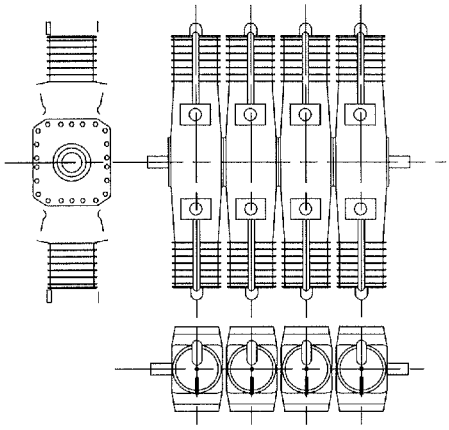

In addition, without the need of cylinder lubricant, and the reliance on the flywheels 330, 335 and their associated tubes 601, 603 and hoses 603, 604 under Bernoulli's principle discussed above, the need of lubricant pumps is eliminated. In an aspect, if the opposed-piston engine 100 above is designed to utilize diesel, the fuel is totally consumed at detonation and not burned in the exhaust system 500 as in spark ignited engines. In addition, the use of multiple fuel injectors 1132, as shown in FIG. 31, can also increase the efficiency of the engine 100. Multiple fuel injectors can be used to apply multiple short bursts of fuel into the combustion chamber 130 during the compression stroke for improved fuel and air mixing.

Figure 22:
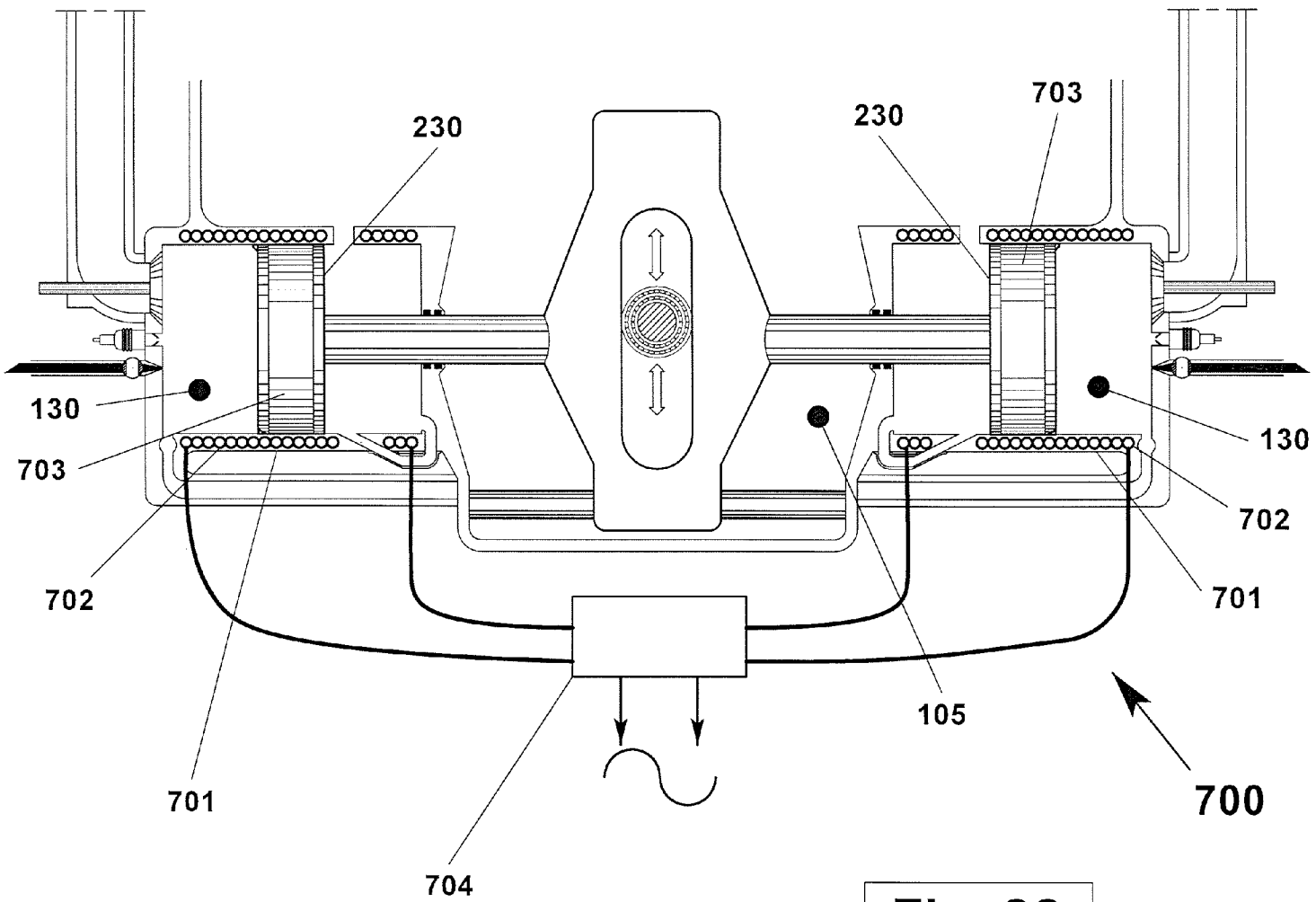
FIG. 22 is a partial cross-sectional view of a two cylinder, two cycle opposed-piston engine configured to function as an electric generator according to an aspect.

FIG. 22 illustrates an additional engine configuration for an opposed-piston engine 100 that can be used as a generator according to an aspect. Like the opposed-piston engine of FIGS. 1-21, the opposed-piston engine 700 utilizes combustion pistons 230 that do not make physical contact with the walls of the combustion cylinders 130. Therefore, the interior walls of the combustion cylinders 130 can comprise an appropriate ceramic lining 701 with wire coils 702 embedded within. The encased windings 702 surround the combustion cylinder 130. A high strength permanent magnet 703 can be integrated into the head of the combustion pistons 230, and as the piston 230 oscillates back and forth in the combustion cylinder 130, the stationary windings 702 interrupt the moving lines of magnetic force emanating from the magnet 703 embedded in the piston 1230. The resulting current induced into the windings 702 is passed through a power conditioning module 704 to be converted into the desired electrical force.

FIGS. 23-32 illustrate an alternative exhaust system 1500 that can be utilized by an opposed-piston engine 100 as described above according to an aspect. In an aspect, the alternative exhaust system 1500 can replace components of the detonator accumulator system 400 and exhaust system 500 discussed above, but carry out the same essential functions, but at higher engine speeds.

In an aspect, the alternative exhaust system 1500 is configured to allow of an exhaust valve to be cam-actuated in both directions. The cam actuated exhaust system 1500 comprises an exhaust valve assembly 1510, a rocker arm assembly 1520, and a push rod assembly 1530, and an exhaust manifold 1540. In an aspect, the cam actuated exhaust system 1500 is configured to operate with two cam flywheels 1330, 1335, both of which include cams 1330*a*, 1335 respectively, discussed in more detail below.

Figure 23:
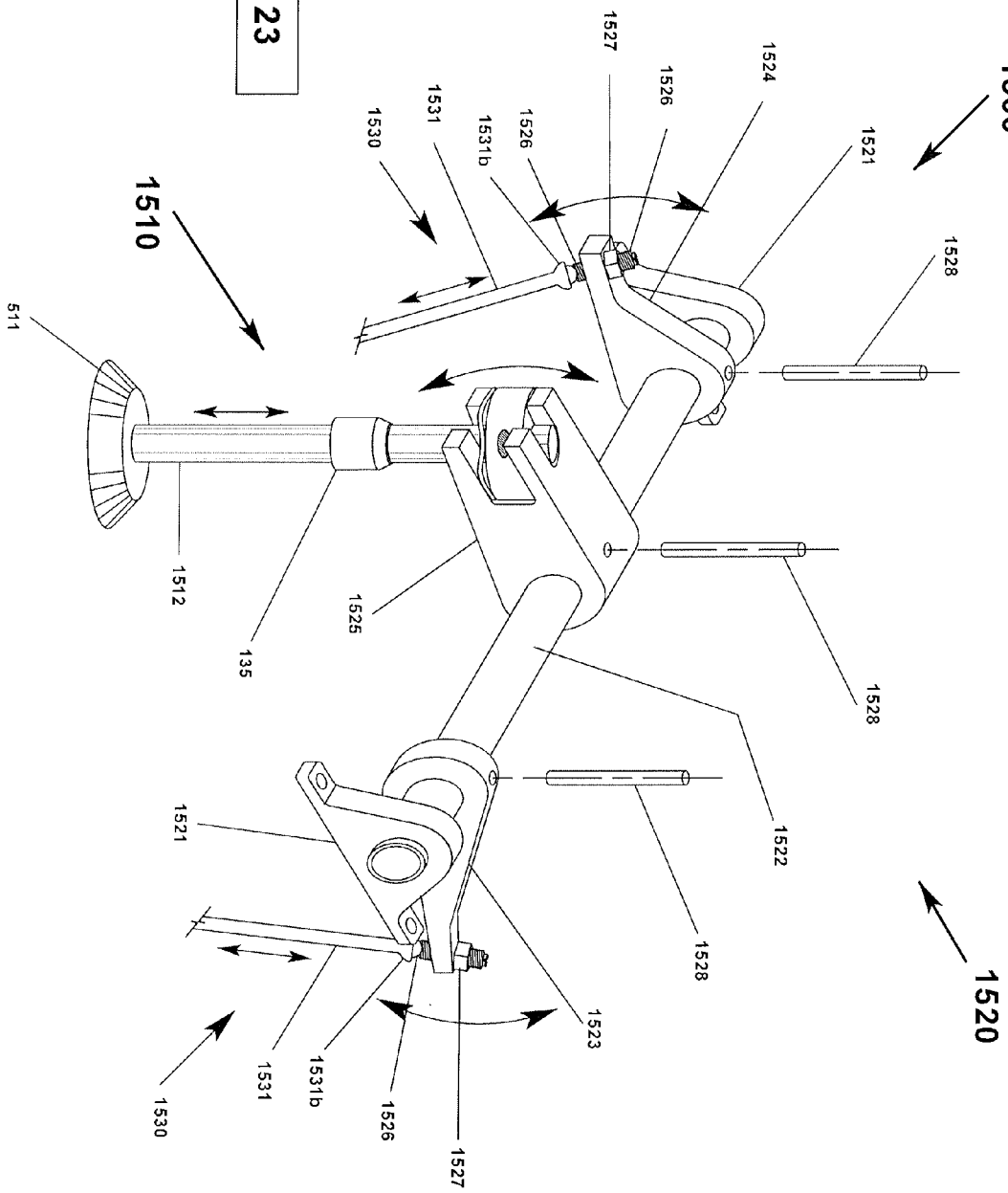
FIG. 23 is a partial perspective view of a high speed dual action valve train assembly for an exhaust system according to an aspect.
Figure 24:
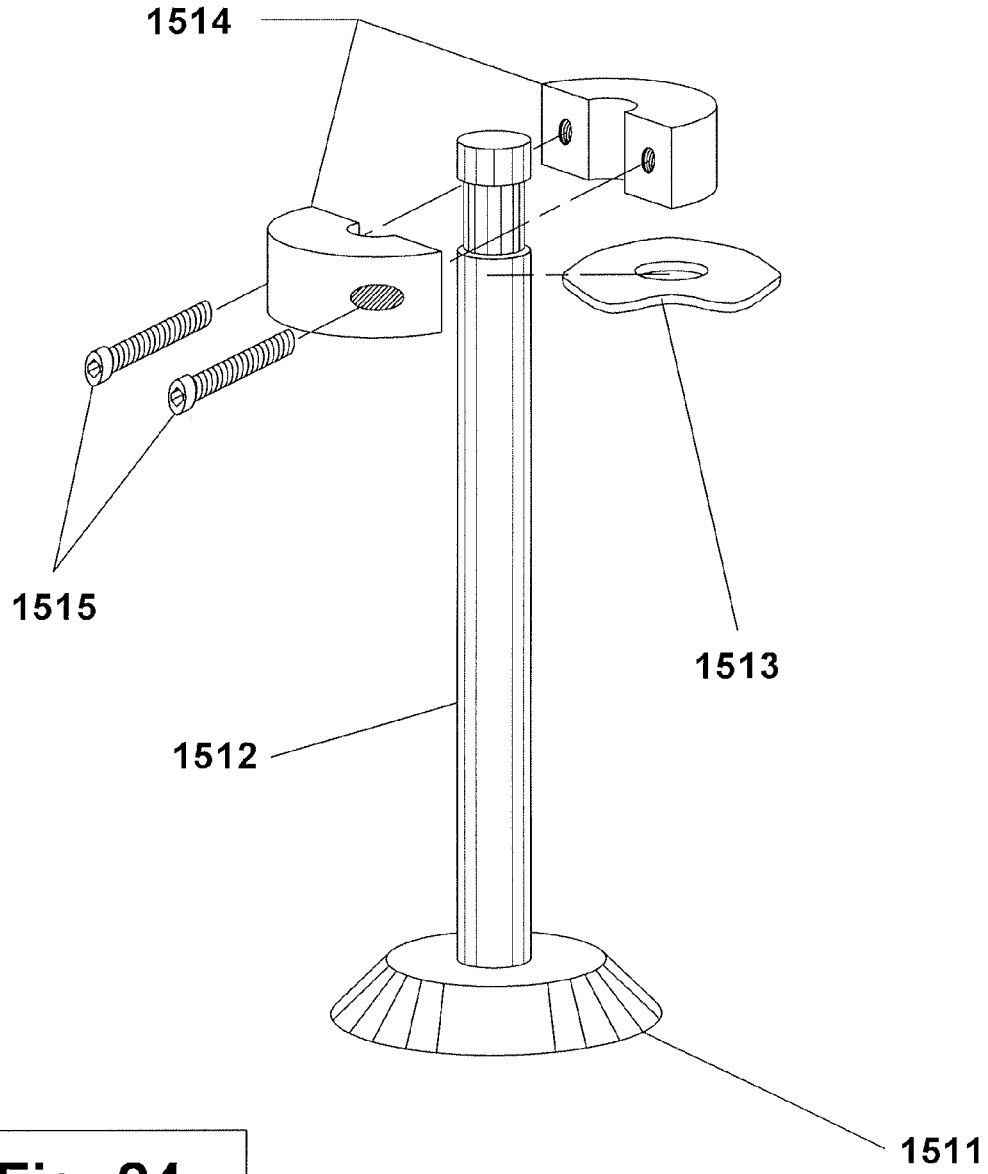
FIG. 24 is an exploded top perspective view of a modified exhaust valve of the exhaust valve assembly of FIG. 23 according to an aspect.
Figure 25:
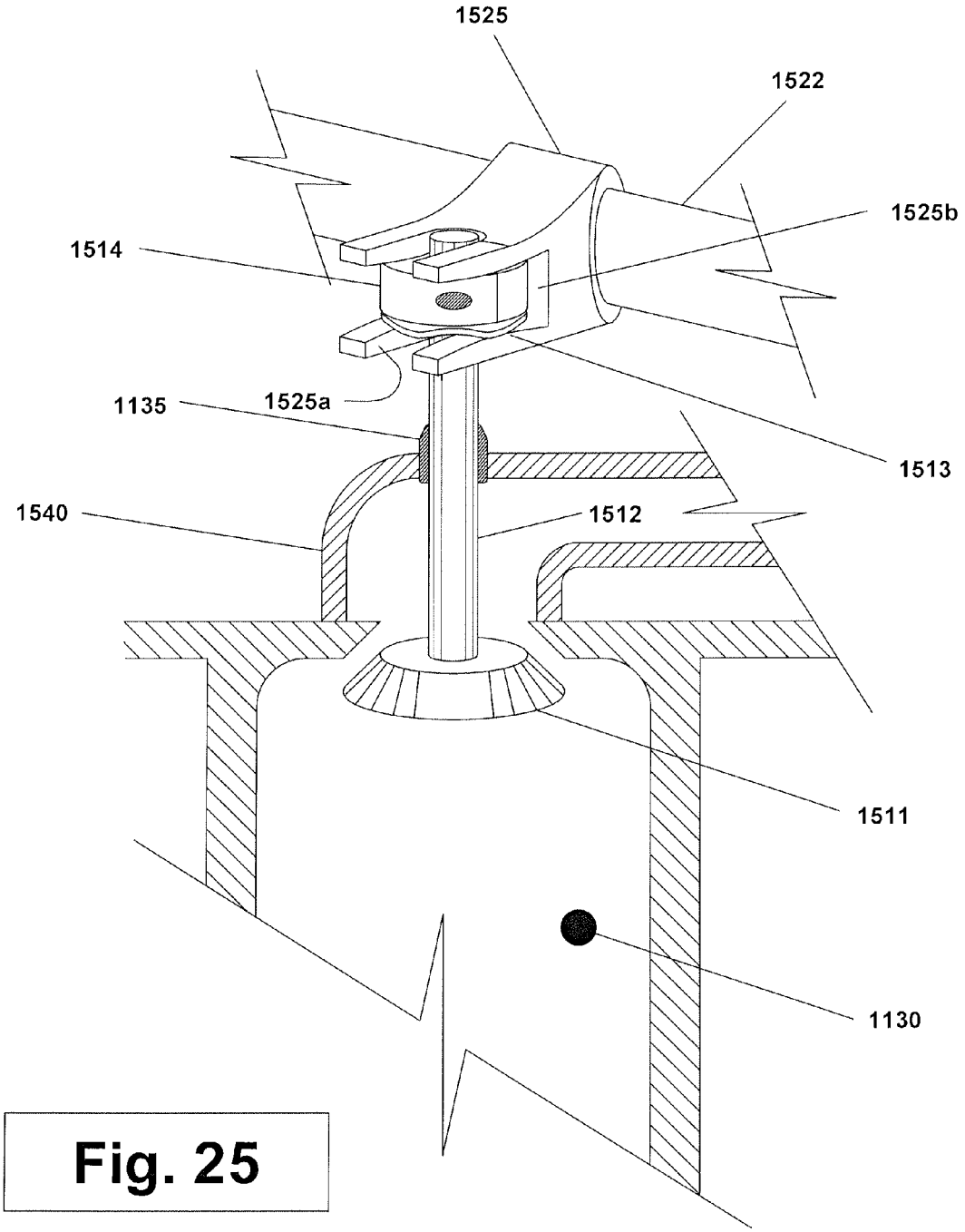
FIG. 25 is an oblique and cut-away view of an exhaust valve and actuation member with respect to a cylinder and exhaust manifold according to an aspect.

In an aspect, the exhaust valve assembly 1510 of the cam actuated exhaust system 1500 comprises an exhaust valve 1511, a stem 1512, a valve closer spring 1513, a valve keeper collar 1514, and valve collar set screws 1515, as illustrated in FIGS. 23-25. The exhaust valve 1511 is configured to be received into an exhaust valve guide 1135 that is configured to be within a wall of the exhaust manifold 1540, shown in FIGS. 23 and 25. The valve closer spring 1513 is secured to the stem 1512 of the valve 1511 through the combination of the valve keeper collar 1514 and valve collar set screws 1515, as illustrated in FIG. 24. In an aspect the valve closer spring 1513 is configured to assist the exhaust valve 1511 to form the seal between the exhaust port of the combustion cylinder and the exhaust manifold by forcing the exhaust valve 1511 to close the small gap based upon the force applied by the valve closer spring 1513. In an aspect, the valve closer spring 1513 can include a washer 1513 configured to apply such a force. The valve closer spring 1513 can include, but is not limited to, a wave washer.

In an aspect, the rocker arm assembly 1520 is configured to operate and control the operation of the exhaust valve assembly 1510. The rocker arm assembly 1520 comprises rocker arm bearing supports 1521, a rocker arm shaft 1522, an exhaust open actuator arm 1523, an exhaust close actuator arm 1524, and an exhaust valve actuator arm 1525. The rocker arm bearing supports 1521 of the rocker assembly 1520 are configured to rotationally support the rocker arm shaft 1522. The exhaust open actuator arm 1523, the exhaust close actuator arm 1524, and the exhaust valve actuator arm 1525 are configured to be secured to the rocker arm shaft 1522. In an aspect, the exhaust open actuator arm 1523 and the exhaust close actuator arm 1524 are oriented in opposite directions on the rocker arm shaft 1522. In an aspect, the three arms 1523, 1524, and 1525 are secured through locking pins 1528, which are received by corresponding apertures (not shown) within the rocker arm shaft 1522. Therefore, the three arms 1523, 1524, and 1525 rotate with the rocker arm shaft 1522, as discussed in more detail below.

Similar to the rocker arm 521 of the rocker arm assembly 500 discussed above, the exhaust open actuator arm 1523 and the exhaust close actuator arm 1524 are configured to receive an adjustment pivot 1526 secured with a lock nut 1527, as shown in FIG. 22. The adjustment pivot 1526 is configured to mate with a push rod 1531 of the push rod assembly 1530, discussed in more detail below. In an aspect, the exhaust open actuator arm 1523 and the exhaust close actuator arm 1524 are secured to the rocker arm shaft 1522 pointing in the opposite directions so to have their respective adjustment pivots 1526 180 degrees from one another, as shown in FIG. 22.

The exhaust valve actuator arm 1525 is configured to engage the exhaust valve assembly 1510, as shown in FIGS. 23 and 25. In an aspect, the exhaust valve actuator arm 1525 includes two slots 1525*a*, 1525*b* that cross one another and are configured to receive a portion of the exhaust valve assembly 1510. One of the slots 1525*b* is configured to have a width long enough to retain the valve closer spring 1513 and valve keeper collar 1514. The other slot 1525*a* is configured to receive the exposed portions of the stem 1512 not covered by the valve keeper collar 1514, as shown in FIGS. 22 and 24.

Figure 26:
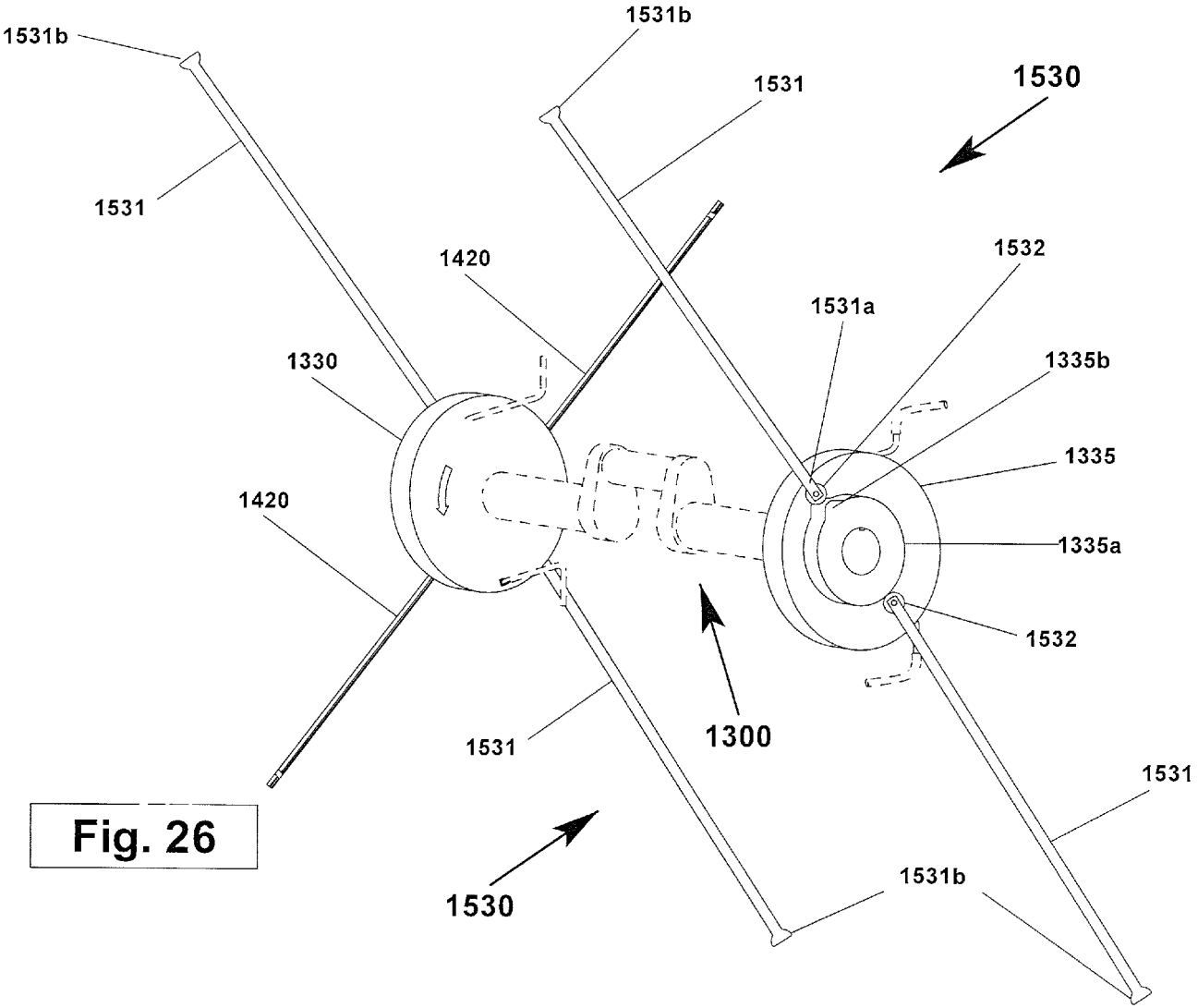
FIG. 26 is a side perspective view of components of an exhaust system and detonator accumulator system according to an aspect.

The push rod assembly 1530 is configured to interact with the two flywheels 1330, 1335 and the rocker arm assembly 1520. The push rod assembly 1530 of accelerated exhaust system 1500 is similar to the push rod assembly 530 of the exhaust system 500 discussed above, but is configured to operate with an exhaust valve closing flywheel 1330 and an exhaust valve opening cam flywheel 1335. Both flywheels 1330, 1335 are configured to be placed on the respective ends of a crankshaft assembly 1330, as shown in FIGS. 25-26. In an aspect, each flywheel 1330, 1335 is configured to have an aperture 1334, 1336 that receives ends of a detonator main journal 1302 and exhaust main journal 1301 respectively of the crankshaft assembly 1300. The cam 1330*a* of the exhaust valve closing cam flywheel 1330 is configured to close of the exhaust valve 1511, whereas the cam 1335*a* of the exhaust valve opening cam flywheel 1335 is configured to open the exhaust valve 1511, discussed in detail below. Therefore, the push rod assembly 1530 includes a push rod 1531 for each cam flywheel 1330, 1335 for each section of the engine.

Figure 27:
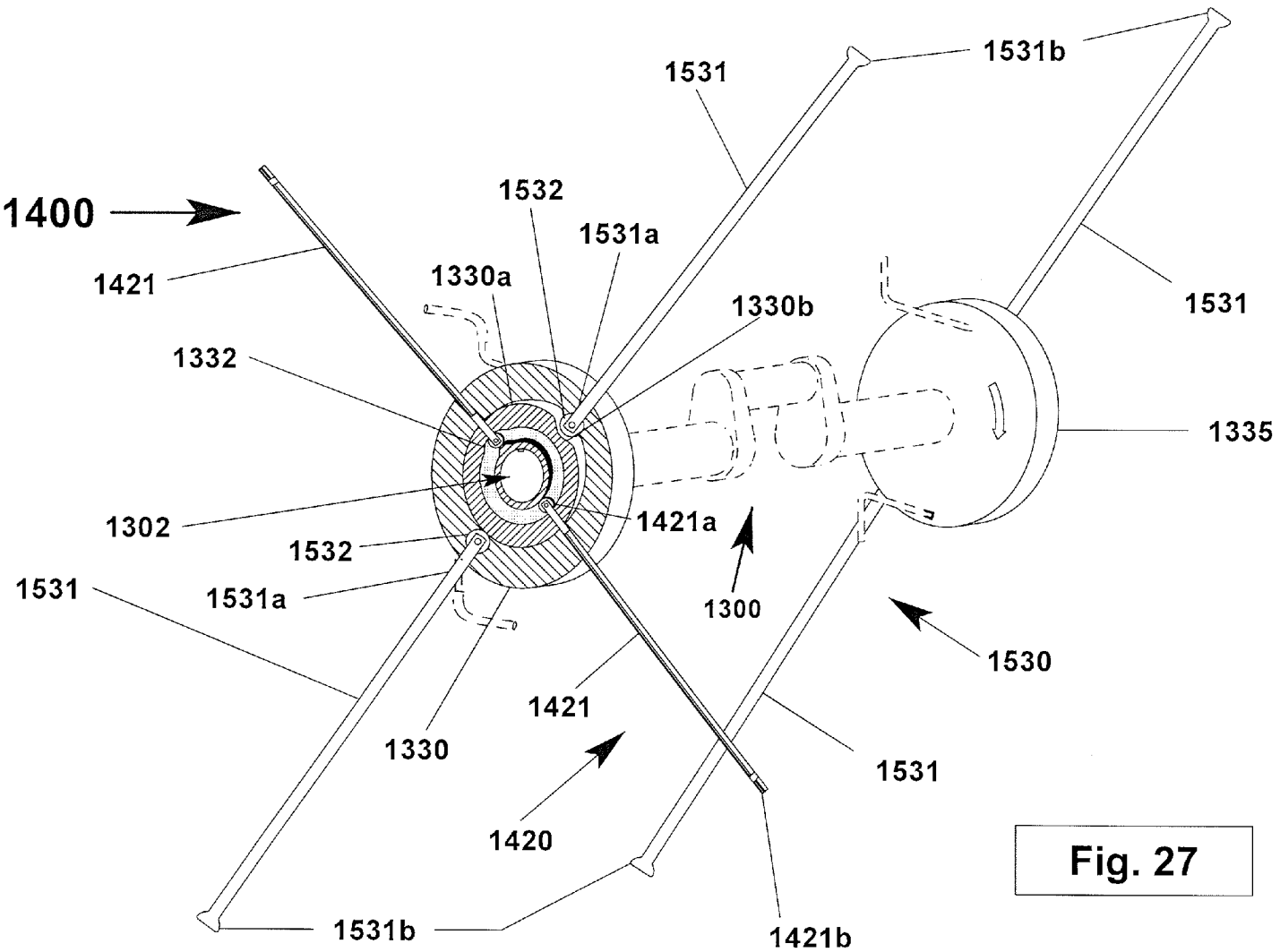
FIG. 27 is another side perspective view of components of an exhaust system and detonator accumulator system according to an aspect.

Each push rod 1531 includes a cam end 1531*a* and a pivot end 1531*b*. The cam end 1531*a* of the push rod 1531 is configured to engage the cams 1330*a*, 1335*a* of the respective flywheels 1330, 1335 in which with the rods 1531 interact. In an aspect, the cam end 1.531*a* of the push rod 1531 is configured to receive a cam follower 1532, as shown in FIGS. 26-27. The cam end 1531*a* and the cam follower 1532 can be configured and include components similar to the push rod assembly 530 discussed above. The cam followers 1532 are configured to engage the cams 1330*a*, 1335*a* of the exhaust valve closing flywheel 1330 and an exhaust valve opening flywheel 1335 as both flywheels 1330, 1335 rotate. The pivot ends 1531*b* of the push rods 1531 are configured to engage the ends of the adjustment pivots 1524 of the exhaust open actuator arm 1523 and exhaust close actuator arm 1524.

Figure 29:
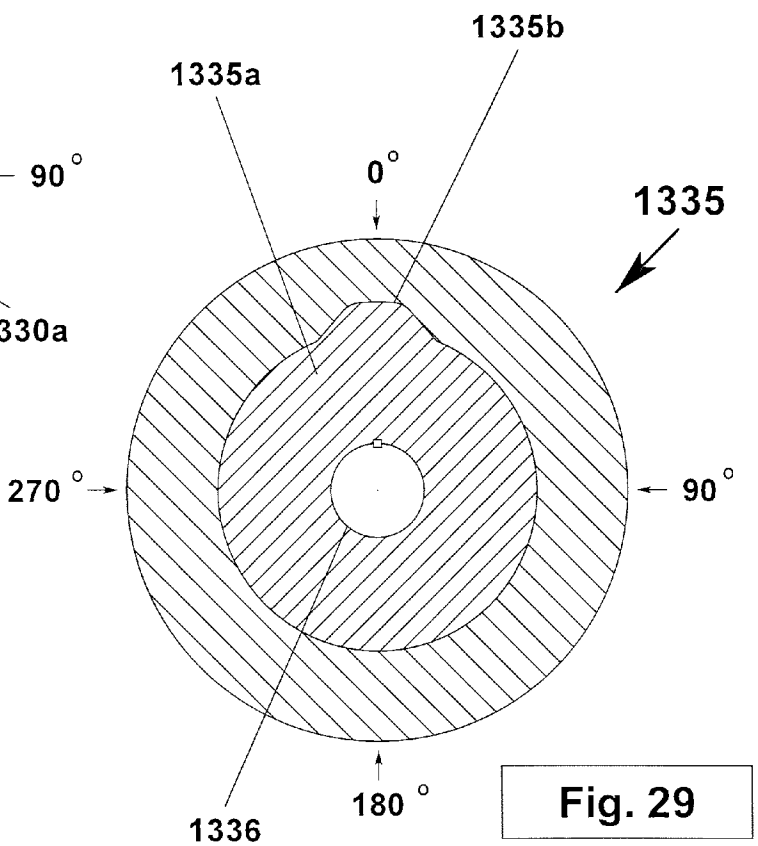
FIG. 29 is a cross-sectional view of a cam according to an aspect.
Figure 28:
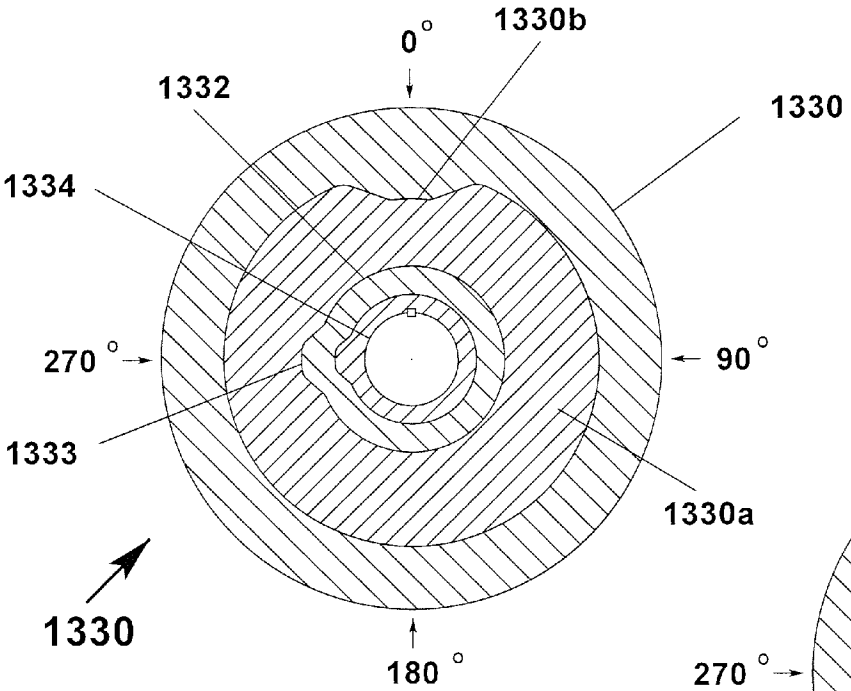
FIG. 28 is a cross-sectional view of a cam according to an aspect.
Figure 30:
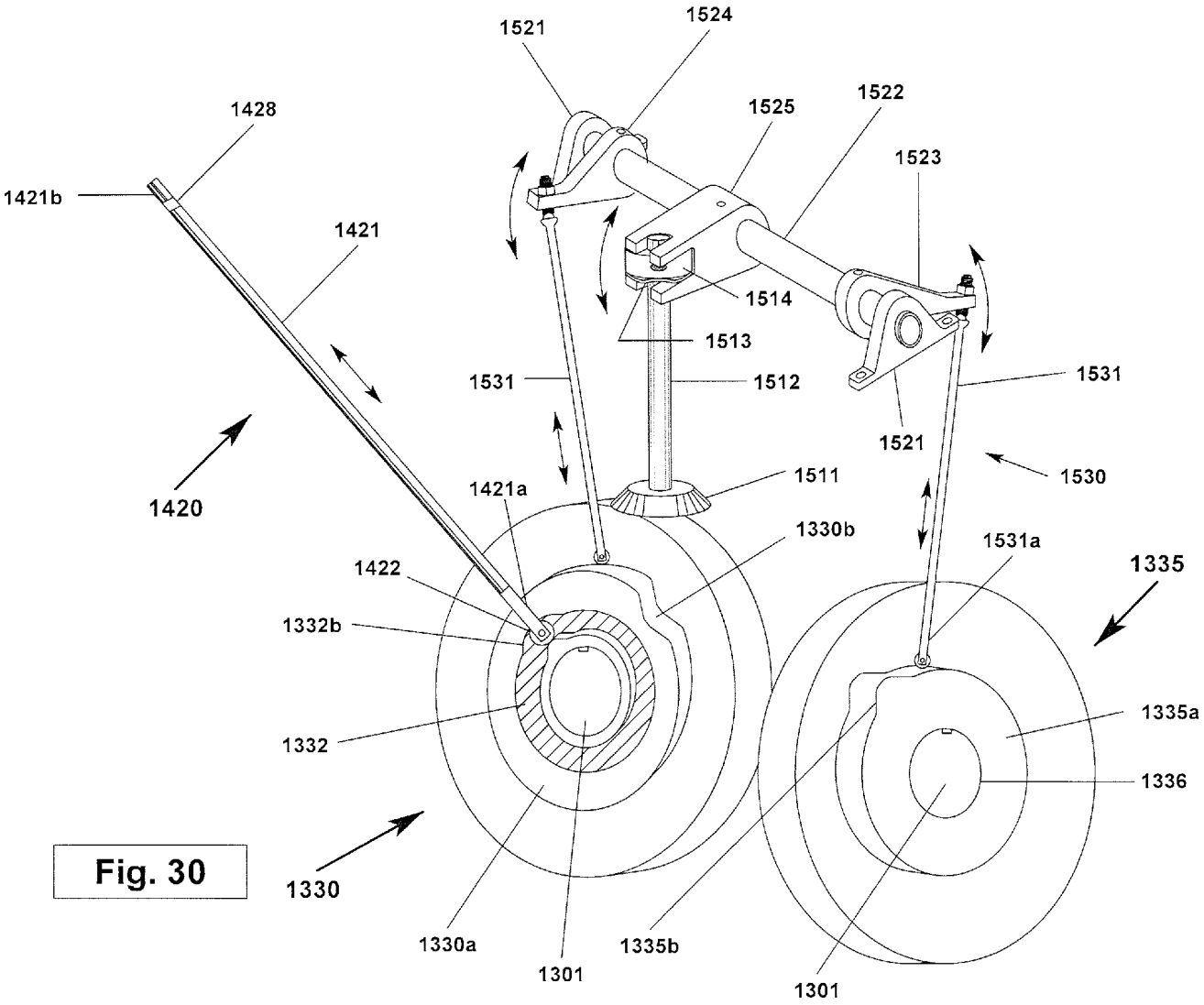
FIG. 30 is distorted perspective view of cams of FIGS. 28 and 29 working with the high speed dual action valve train assembly of FIG. 23.

In an aspect, as shown in FIGS. 28-30, the closing cam 1330*a* can be configured to include an indention/curve portion 1330*b* that allows for its push rod assembly 1530 to move without preventative resistance to allow the push rod assembly 1531 associated with the opening cam 1335*a*, and its protrusion 1335*b*, to be able to push the exhaust open actuator arm 1523. Once both the indention 1330*b* and protrusion 1335*b* have rotated past their respective push rod assemblies 1530, the closing cam 1330*a* will engage its push rod assembly 1530 to engage the exhaust close actuator arm 1524. FIGS. 28-30 illustrate the relationship between the cams 1330*a*, 1335*a* and their respective indention 1330*b* or protrusion 1335*b*. In an exemplary aspect, the indention 1330*b* and the protrusion 1335*b* should be aligned at the same position on their respective cams 1330*a*, 1335*a*, as shown in FIGS. 28-29.

In an aspect, as the exhaust valve closing flywheel 1330 and the exhaust valve opening flywheel 1335 rotate, the respective cams 1330*a* and 1335*a* oscillate the pushrods 1521 to alternately transmit the cam action to the corresponding actuator arms 1524 and 1523, causing the rocker arm shaft 1522 to rotate sufficiently to rotate the exhaust valve actuator arm 1525 up and down to open and close the exhaust valve 1511. Such a configuration allows the exhaust close actuator arm 1525 sufficient tolerance to avoid too tight of an adjustment that could cause the cam actuated exhaust system 1500 undo stress while facilitating a good seal when necessary.

For example, when a cam follower 1532 is engaged by the cam 1330*a* of the exhaust valve closing flywheel 1330, the pivot end 1531*b* of the push rod 1531 engages the adjustment pivot 1524 of the exhaust close actuator arm 1524, which rotates the exhaust valve actuator arm 1525, through the rocker arm shaft 1522, to close the exhaust valve 1511. Since the valve closer spring 1513 is accelerated by the action of the cam actuated exhaust system 1500, the spring 1513 has the inertia to facilitate closing the last small amount of the opening into the exhaust manifold 1540 to affect a seal.

When a cam follower 1532 is engaged by the extension 1335*b* of cam 1335*a* of the exhaust valve open flywheel 1335 and the cam follower 1532 is received by the indention 1330*b* of the valve close cam flywheel 1330, the pivot end 1531*b* of the push rod 1531 engages the adjustment pivot 1524 of the exhaust open actuator arm 1523, which rotates the exhaust valve actuator arm 1525, through the rocker arm shaft 1522, to open the exhaust valve 1511. The cam actuated exhaust system 1500 described above allows for high speed valve actuation, with the use of the cams to fully open and close the exhaust valve 1511, while accelerating the valve 1511 and valve closer spring 1513 to finish the last motion to create a seal. This prevents valve floating at high speeds.

In an aspect, the cam 1330*a* of the exhaust valve closing flywheel 1330 can be configured to be utilized by a high speed detonator accumulator system 1400 as illustrated in FIGS. 27-32. In an aspect, the detonator accumulator system 1400 includes a detonation accumulator chamber (not shown) and a detonation accumulator valve assembly 1420. While not shown, the detonation accumulator chamber of the high speed detonator accumulator system 1400 is similar to the detonator accumulator system 400 of the embodiment of FIGS. 1-21 discussed above and can be formed within the engine case, extending into the combustion cylinder.

The detonation accumulator valve assembly 1420 is configured to control the release of the gases from the detonation accumulator chamber into the combustion cylinder. In an aspect, the detonation accumulator valve assembly 1420 includes a push rod 1421, as shown in FIGS. 27, 30 and 31. The push rod 1421 includes a cam end 1421*a* and a chamber end 1421*b*. The cam end 1421*a* of the push rod 1421 is configured to engage the exhaust valve closing cam flywheel 1330. In an aspect, the cam end 1421*a* of the push rod 1421 is configured to receive a cam follower 1422. The end 1421*a* of the push rod 1421 can be configured to include a cam follower mount 1423 to receive the cam follower 1422. In an aspect, the combination of the mounted cam followers 1422 engaging the cam 1330*a* and the channels within the engine case within which the push rods 1421 are retained secure the push rods 1421. In an aspect, the follower mount 1423 can be configured to prevent the push rod 1421 from rotating within channels in the engine case.

In an aspect, the cam follower 1422 is configured to engage the cam 1330*a* of the exhaust valve closing flywheel 1330 as it rotates. In an aspect, the cam 1330*a* of the exhaust valve closing cam flywheel 1330 includes a cam follower raceway 1332 that is configured to receive the cam follower 1422. In an aspect, the cam follower raceway 1332 is circular in shape, but includes an indented portion 1333 that functions in a similar way as the cam 1330*a* (i.e., only applying pressure to the push rod 1421 when an extended portion engages the push rod in the rotation). The outer portion of the raceway 1332 acts to close the detonation aperture 1428 of the detonation valve assembly 1420. The cam follower mount 1423 can be configured to be an extension of the push rod 1421 configured to place the cam follower 1422 within the raceway 1332 without engaging the top surface of the closing cam 1330*a*. In an aspect, the cam follower mount 1423 can be thinner and flatter than the rest of the push rod 421 to ensure no interaction with itself and the surface of the closing cam 330*a*.

The chamber end 1421*b* of the push rod 1421 is configured to interact with the detonation accumulator chamber (not shown), by controlling the access of the detonation accumulator chamber to the combustion cylinder 1330 of the engine in the similar fashion a discussed above. The push rod 1421 includes a detonation aperture 1428 approximate the chamber end 1421*b*. When the indented portion 1333 of the cam follower raceway 1332 engages the cam follower 1422 of the flywheel end 1421*a*, the detonation accumulator valve assembly 1420 is configured to align the detonation aperture 1428 with the end of the detonation accumulator chamber adjacent the combustion cylinder to allow the hot and pressurized mixed gases into the combustion cylinder 1130. In an aspect, the chamber end 1421*b* is configured to receive a return spring (not shown) coupled to the engine case. When the return spring is fully extended (i.e., not compressed), the detonation aperture 1428 is not aligned with the detonation accumulator chamber. The race way 1332 of the cam 1330*a* opens and closes the valve assembly with each revolution of the cam 1330*a*.

As stated above, the opposed-piston engine 100 can be aligned and oriented in any fashion. In addition, multiple opposed-piston engines can be arranged in series with one another in various combinations as a result. The various combinations and alignments of the multiple opposed-piston engines can include, but are not limited to, the various combinations and orientations of engines shown in FIGS. 33-36.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention. To the extent necessary to understand or complete the disclosure of the present invention, all publications, patents, and patent applications mentioned herein are expressly incorporated by reference therein to the same extent as though each were individually so incorporated.

Having thus described exemplary embodiments of the present invention, those skilled in the art will appreciate that the within disclosures are exemplary only and that various other alternatives, adaptations, and modifications may be made within the scope of the present invention. Accordingly, the present invention is not limited to the specific embodiments as illustrated herein, but is only limited by the following claims.

What is claimed is:

1. An opposed piston engine comprising:

a) an engine case comprising:

i) a pair of combustion cylinders aligned with one another; and ii) a crankcase, wherein the pair of combustion cylinders are separated by the crankcase; and b) a scotch yoke assembly housed within the crankcase, the scotch yoke assembly comprising:

i) a scotch yoke base;

ii) a scotch yoke guide shaft rigidly connected to the engine case within the crankcase; and iii) a pair of combustion pistons rigidly connected to the scotch yoke base, wherein each one of the pair of combustion pistons is configured to annularly move within one of the pair of combustion cylinders without actual contact between the combustion pistons and walls of the combustion cylinders, wherein the combination of the combustion pistons moving within the combustion cylinders forms an inviscid layer between walls of the combustion cylinders and heads of the pistons, the inviscid layer forming a seal between the walls and the heads of the combustion pistons, the inviscid layer consisting of air or a mixture of air and fuel that eliminates the need for a lubricant within the combustion cylinders.

2. The opposed piston engine of claim 1, further comprising a pair of compression cylinders aligned with one another, separated by the crankcase and in parallel with the pair of combustion cylinders; and a pair of compression pistons, wherein the compression pistons are rigidly connected to the scotch yoke base and wherein each one of the pair of compression pistons is configured to annularly move within one of the pair of compression cylinders to compress air, wherein the combination of the pair of compression cylinders and the pair of compression pistons are configured to pass the compressed air to the pair of combustion cylinders.

3. The opposed piston engine of claim 2, wherein the compression cylinders are configured to collect and transform ambient air to the compressed air.

4. The opposed engine of claim 3, wherein the engine case further comprises a pair of accumulator chambers aligned with one another and separated by the crankcase, wherein the accumulator chambers are configured to receive the compressed air from the compression cylinders and to transfer the compressed air to the combustion cylinders.

5. The opposed engine of claim 1, wherein the crankcase is configured to retain a crankshaft assembly and lubricant, wherein the crankcase is configured to isolate the lubricant from the pair of combustion cylinders.

6. The opposed engine of claim 5, further comprising an exhaust system, wherein the exhaust system is actuated by the crankshaft assembly.

7. The opposed engine of claim 6, wherein the crankshaft assembly further comprises a cam flywheel, wherein the first cam flywheel is configured to actuate the exhaust system.

8. The opposed engine of claim 7, wherein the first cam flywheel comprises a cam configured to actuate the exhaust system.

9. The opposed engine of claim 7, wherein the first cam flywheel is configured to lubricate the exhaust system.

10. The opposed engine of claim 9, further comprising a second cam flywheel, wherein the first cam flywheel and the second cam flywheel are driven by a crankshaft and are configured to interface with the lubricant within the crankcase to vaporize the lubricant through parasitic drag.

11. The opposed engine of claim 10, wherein the first cam flywheel and the second cam flywheel are further configured to circulate the vaporized lubricant to the exhaust valve system through Bernoulli's principle.

12. The opposed engine of claim 5, wherein the scotch yoke base is configured to transfer power from the pair of combustion cylinders to the crankshaft assembly.

13. The opposed engine of claim 12, further comprising a detonation accumulator system, wherein the detonation accumulator system is actuated by the crankshaft assembly.

14. The opposed engine of claim 13, wherein the crankshaft assembly further comprises a cam flywheel configured to actuate the detonation accumulator system.

15. The opposed engine of claim 14, wherein the detonation accumulator system comprises a detonation accumulator chamber configured to capture gases of a high temperature and pressure produced during a power cycle.

16. An opposed piston engine, comprising:

a) an engine case comprising:

i) a pair of combustion cylinders aligned with one another;

ii) a pair of compression cylinders aligned with one another and in parallel with the pair of combustion cylinders, wherein the pair of compression cylinders are configured to collect ambient air in the compression cylinders; and iii) a crankcase, wherein the pair of compression cylinders and the pair of combustion cylinders are separated by the crankcase;

b) a scotch yoke assembly housed with the crankcase, the scotch yoke assembly comprising:

i) a scotch yoke base;

ii) a slotted raceway within the scotch yoke base;

iii) a scotch yoke guide shaft rigidly connected to the engine case within the crankcase;

iv) a pair of combustion pistons rigidly connected to the scotch yoke base by combustion connecting rods, wherein each one of the pair of combustion pistons is configured to annularly move within one of the pair of combustion cylinders; and v) a pair of compression pistons rigidly connected to the scotch yoke base by at least one compression connecting rod, wherein each one of the pair of compression pistons is configured to annularly move within one of the pair of compression cylinders to compress the ambient air, wherein the combination of the scotch yoke base, the scotch yoke guide shaft, the combustion connecting rods, and the at least one compression connecting rod combustion pistons assist in aligning the scotch yoke base and place the combustion pistons in close proximity of walls of the combustion cylinders without actual contact between the combustion pistons and walls of the combustion cylinders, wherein the combination of the combustion pistons moving within the combustion cylinders in close proximity to the walls of the combustion cylinders forms a seal consisting of an inviscid layer between the walls of the combustion cylinders and the combustion pistons, the inviscid layer consisting of air or a mixture of air and fuel that eliminates the need for a lubricant within the combustion cylinders; and c) a crankshaft assembly comprising a bearing assembly configured to interact with the slotted raceway of the scotch yoke assembly and a rod journal of the crankshaft assembly, wherein the scotch yoke assembly is configured to transfer power from the pair of combustion pistons to the crankshaft assembly through the bearing assembly.

17. The opposed engine of claim 16, wherein the engine case further comprises a pair of accumulator chambers aligned with one another and separated by the crankcase, wherein the accumulator chambers are configured to receive the compressed air from the compression cylinders and to transfer the compressed air to the combustion cylinders.

18. The opposed engine of claim 16 further comprising a cam actuated exhaust system configured to operate exhaust valves at a high speed and in more than one direction, wherein the crankshaft assembly further comprises two cam flywheels configured to operate the cam actuated exhaust system, wherein the crankcase is further configured to contain the two cam flywheels.

19. The opposed engine of claim 16, wherein the bearing assembly comprises at least three races and two sets of bearing elements, wherein each of the at least two sets of bearing elements is located between two of the at least three races.

20. The opposed engine of claim 16, wherein each of the pair of combustion cylinders comprises a plurality of fuel injectors.

21. An internal combustion engine comprising:

a) at least one combustion cylinder;

b) at least one combustion piston configured to operate within the at least one combustion cylinder in close proximity to walls of the combustion cylinder without actual contact between the at least one combustion cylinder and the at least one combustion piston; and c) a seal consisting of an inviscid layer of a mixture of air and fuel formed from the at least one combustion piston moving quickly within the at least one combustion cylinder eliminating the need of a lubricant within the at least one combustion cylinder.

22. The internal combustion engine of claim 21, further comprising a Scotch yoke assembly comprising a Scotch yoke base and a Scotch yoke guide shaft configured to be received by the Scotch yoke base, wherein the at least one combustion piston is rigidly connected to the Scotch yoke base.

23. The internal combustion engine of claim 21, further comprising at least one compression cylinder and at least one compression cylinder, wherein the at least one compression cylinder is configured to collect and compress ambient air and deliver the compressed air to the combustion cylinder.

24. The internal combustion engine of claim 23, further comprising a Scotch yoke assembly comprising a Scotch yoke base and a Scotch yoke guide shaft configured to be received by the Scotch yoke base, wherein the at least one combustion piston and the at least one compression piston are rigidly connected to the Scotch yoke base.

25. The internal combustion engine of claim 21, further comprising a crankcase configured to house a crankshaft assembly and lubricant, wherein the crankcase is further configured to isolate the lubricant from the at least one combustion cylinder and the at least one combustion piston.

26. The internal combustion engine of claim 21, further comprising a power condition module, wherein the combustion cylinder further comprises walls of ceramic material comprising wire coils and the combustion piston further comprises a head-integrated magnet, wherein the oscillation of the combustion piston within the combustion cylinder creates a current that is sent to the power condition module.

* * * * *